US010941680B2

(12) United States Patent
McCarthy, Jr. et al.

(10) Patent No.: US 10,941,680 B2
(45) Date of Patent: Mar. 9, 2021

(54) DISCRETE VARIABLE VALVE LIFT ENGINE SYSTEMS AND METHODS

(71) Applicant: Eaton Corporation, Cleveland, OH (US)

(72) Inventors: James E. McCarthy, Jr., Kalamazoo, MI (US); Edwin Scott Brownell, Marshall, MI (US); Nikhil Saggam, Pune (IN); Susheel Dharmadhikari, Pune (IN)

(73) Assignee: Eaton Corporation, Cleveland, OH (US)

( * ) Notice: Subject to any disclaimer, the term of this patent is extended or adjusted under 35 U.S.C. 154(b) by 47 days.

(21) Appl. No.: 16/022,054

(22) Filed: Jun. 28, 2018

(65) Prior Publication Data

US 2018/0306073 A1 Oct. 25, 2018

Related U.S. Application Data

(63) Continuation-in-part of application No. PCT/US2016/068118, filed on Dec. 21, 2016.
(Continued)

(30) Foreign Application Priority Data

Aug. 31, 2016 (IN) ..... 201611029817
Jun. 27, 2018 (IN) ..... 201811024032

(51) Int. Cl.
*F01L 13/00* (2006.01)
*F01L 1/08* (2006.01)
(Continued)

(52) U.S. Cl.
CPC ..... *F01L 13/0036* (2013.01); *F01L 1/08* (2013.01); *F01L 1/185* (2013.01); *F01L 1/2405* (2013.01);
(Continued)

(58) Field of Classification Search
CPC ..... F01L 13/0036; F01L 1/2405; F01L 1/185; F01L 1/08; F01L 2001/186;
(Continued)

(56) References Cited

U.S. PATENT DOCUMENTS 6,314,928 B1 11/2001 Baraszu et al.
2006/0185646 A1 8/2006 Heel et al.
(Continued)

FOREIGN PATENT DOCUMENTS

CN 102084107 A 6/2011
CN 104411925 A 3/2015
(Continued)

OTHER PUBLICATIONS

International Search Report and Written Opinion for International Application No. PCT/US2016/068118 dated Apr. 11, 2017, 23 pages.
(Continued)

*Primary Examiner* — Patrick Hamo
*Assistant Examiner* — Wesley G Harris
(74) *Attorney, Agent, or Firm* — RMCK Law Group PLC

(57) ABSTRACT

A method of providing a rocker arm set for a valvetrain includes providing a first rocker arm configured as a switching rocker arm for a first intake valve, and providing a second rocker arm configured as a fixed rocker arm for a second intake valve, the second rocker arm operating in a normal Otto cycle mode. The first rocker arm operates in a late intake valve closing (LIVC) mode where the first rocker arm is configured to close the first intake valve later than the second intake valve.

19 Claims, 32 Drawing Sheets

Related U.S. Application Data

(60) Provisional application No. 62/271,391, filed on Dec. 28, 2015, provisional application No. 62/279,976, filed on Jan. 18, 2016, provisional application No. 62/349,983, filed on Jun. 14, 2016, provisional application No. 62/350,621, filed on Jun. 15, 2016, provisional application No. 62/571,330, filed on Oct. 12, 2017.

(51) Int. Cl.

| | |
|---|---|
| ***F01L 1/18*** | (2006.01) |
| ***F01L 1/24*** | (2006.01) |
| *F01L 1/46* | (2006.01) |
| *F01L 13/06* | (2006.01) |
| *F01L 1/14* | (2006.01) |

(52) U.S. Cl.

CPC ..... *F01L 1/2422* (2013.01); *F01L 1/146* (2013.01); *F01L 13/06* (2013.01); *F01L 2001/186* (2013.01); *F01L 2001/467* (2013.01); *F01L 2305/00* (2020.05); *F01L 2800/06* (2013.01); *F01L 2800/08* (2013.01); *F01L 2820/01* (2013.01)

(58) Field of Classification Search

CPC ..... F01L 2800/08; F01L 2105/00; F01L 2001/467; F01L 2820/01; F01L 13/06; F01L 1/2422; F01L 1/146; F01L 13/0005; F01L 1/20; F01L 1/22; F01L 2013/0089; F01L 2800/06; F01L 2305/00; F02D 41/0087; F02D 17/02; F02D 41/0002; F02D 41/008

USPC ..... 123/90.16, 90.15, 90.39–90.41, 123/90.43–90.45

See application file for complete search history.

(56) References Cited

U.S. PATENT DOCUMENTS

| | | | | |
|---|---|---|---|---|
| 2007/0039573 | A1 | 2/2007 | Deierlein | |
| 2009/0217893 | A1* | 9/2009 | Fujita | F01L 1/185 123/90.12 |
| 2010/0050965 | A1 | 3/2010 | Nakamura | |
| 2011/0107987 | A1* | 5/2011 | Murata | F01L 1/34 123/90.15 |
| 2011/0139099 | A1* | 6/2011 | Roe | F01L 1/267 123/90.1 |
| 2011/0226208 | A1 | 9/2011 | Zurface et al. | |
| 2013/0146008 | A1 | 6/2013 | Stoody | |
| 2013/0312689 | A1* | 11/2013 | Zurface | F01L 13/0036 123/90.45 |
| 2014/0290608 | A1 | 10/2014 | Radulescu | |
| 2015/0267574 | A1 | 9/2015 | Radulescu et al. | |

FOREIGN PATENT DOCUMENTS

| | | | | |
|---|---|---|---|---|
| CN | 104903553 | A | 9/2015 | |
| DE | 102005015852 | A1 * | 10/2006 | F01L 1/08 |
| EP | 2672092 | A1 | 12/2013 | |
| JP | 2006329022 | A | 12/2006 | |
| JP | 2012057491 | A | 3/2012 | |
| JP | 2013053609 | A | 3/2013 | |
| WO | WO-2007028482 | A1 * | 3/2007 | F01L 13/0036 |

OTHER PUBLICATIONS

International Search Report and Written Opinion for International Application No. PCT/US2016/068140 dated Apr. 24, 2017, 17 pages.

Supplemental European Search Report for EP Application No. 16882398 dated Jul. 17, 2019.

U.S. Appl. No. 16/022,042, filed Jun. 28, 2018, McCarthy, Jr.

Chinese Office Action for CN Application No. 201680081373.3 dated Mar. 26, 2020.

* cited by examiner

DISCRETE VARIABLE VALVE LIFT ENGINE SYSTEMS AND METHODS

CROSS-REFERENCE TO RELATED APPLICATIONS

This application is a continuation-in-part of International Application No. PCT/US2016/068118 filed Dec. 21, 2016, which claims the benefit of U.S. Provisional Patent Application No. 62/271,391 filed on Dec. 28, 2015, U.S. Provisional Patent Application No. 62/279,976 filed on Jan. 18, 2016, U.S. Provisional Patent Application No. 62/349,983 filed on Jun. 14, 2016, U.S. Provisional Patent Application No. 62/350,621 filed on Jun. 15, 2016, Indian Patent Application No. 201611029817 filed on Aug. 31, 2016, and Indian Patent Application No. 201811024032 filed Jun. 27, 2018. This application claims the benefit of U.S. Provisional Patent Application No. 62/571,330 filed Oct. 12, 2017. The disclosures of each application are incorporated herein by reference.

STATEMENT REGARDING FEDERALLY SPONSORED RESEARCH OR DEVELOPMENT

A portion of this invention was made with government support under DE-EE0005981 awarded by the Department of Energy. The government has certain rights in the invention.

FIELD

The present disclosure relates generally to switching valvetrain systems.

BACKGROUND

Combustion cycles on four-stroke internal combustion engines can be modified to achieve various desired results such as improved fuel economy. In one method, the expansion stroke is increased relative to the compression stroke. The effect is sometimes referred to as a Miller Cycle or as an Atkinson Cycle. The Miller and Atkinson Cycles can be achieved by either closing the intake valve earlier than a normal or Otto Cycle ("Base") with a shorter than normal intake valve lift duration ("EIVC"), or by closing the intake valve later by a longer than normal intake valve lift profile ("LIVC"). See FIG. 1 (Prior Art).

Various systems have been developed for altering the valve-lift characteristics for internal combustion engines. Such systems, commonly known as variable valve timing (VVT) or variable valve actuation (WA), improve fuel economy, reduce emissions, and improve drive comfort over a range of speeds.

Discrete variable valve lift can be obtained through the use of switching rocker arm technology. Switching roller finger followers or switching rocker arms allow for control of valve actuation by alternating between latched and unlatched states, usually involving an inner arm and an outer arm. In some circumstances, these arms engage different cam lobes, such as low-lift lobes, high-lift lobes, and no-lift lobes. Mechanisms are required for switching rocker arm modes in a manner suited for operation of internal combustion engines.

One challenge in a switching rocker arm configuration are the tolerances and variations in the amount of clearance in the mechanism to allow for the switching. Such tolerances ultimately affect when the valve actually opens. In other words, movement of the rocker arm may not directly result in movement of the valve until various clearances are absorbed. Additionally, manufacturing tolerances and engine wear can contribute to additional clearances. Referring to FIG. 2 (Prior Art), one clearance can be referred to as camshaft lash, which is typically defined as a gap between the camshaft and the rocker arm or the clearance between the camshaft lobe not in contact with the switching rocker arm at the base circle and the contact point to the switching rocker arm. Camshaft lash can be absorbed first. Once camshaft lash is absorbed, the outer arm is loaded and rotates to absorb another clearance referred to as latch lash, which is typically defined as the gap between a latch and the rocker arm inner arm latching surface or the clearance between the arms of the rocker arm when there is camshaft lash of zero or greater. The two clearances can be collectively referred to as total mechanical lash. Once the clearances associated with the total mechanical lash are absorbed, the valve can begin to move.

SUMMARY

The impact of lash variation on a switching roller finger follower (SRFF) in a discrete variable valve lift (DVVL) valvetrain is reduced from combustion opening and closing event variation to only closing event variation. The number of SRFFs for a DVVL system on a 3 or 4 valve per cylinder head is reduced in half. A SRFF valvetrain to switch between normal intake event length and duration (Otto cycle) and late intake valve closing through longer direction (Atkinson cycle) is achieved with one SRFF and one fixed roller finger follower (RFF). A strategy of valve lift profiles on the fixed and SRFF is arranged such that the mechanical clearance (lash) on the SRFF impact only on the closing event duration on the late intake valve closure (LIVC) event. The opening event is set by the fixed SRFF during the LIVC event, and the opening and closing events on the Otto cycle mode are set by the fixed RFF.

In one aspect, a method of providing a rocker arm set for a valvetrain is provided. The method includes providing a first rocker arm configured as a switching rocker arm for a first intake valve, and providing a second rocker arm configured as a fixed rocker arm for a second intake valve, the second rocker arm operating in a normal Otto cycle mode. The first rocker arm operates in a late intake valve closing (LIVC) mode where the first rocker arm is configured to close the first intake valve later than the second intake valve.

In addition to the foregoing, the described method may include one or more of the following features: wherein the first rocker arm is provided such that lash variation is encountered exclusively during a valve closing event; providing the first rocker arm to selectively and alternatively operate in a high-lift mode and a low-lift mode; providing the first rocker arm to operate in a high-lift mode, the lash variation being experienced exclusively during the high-lift mode; providing the first rocker arm to encounter the lash variation exclusively during a valve closing event during LIVC mode; providing the switching rocker arm as a switching roller finger follower (SRFF); providing the SRFF for discrete operation in one of a low-lift mode and a high-lift mode; providing the SRFF with an outer arm and an inner arm; providing the SRFF with a latching mechanism configured to selectively latch the outer arm to the inner arm; providing the SRFF with the inner arm configured to be selectively engaged by a low-lift lobe of a cam; providing the SRFF outer arm with a sliding pad configured to be selectively engaged by a high-lift lobe of the cam; providing the SRFF with two outer arms each having a sliding pad configured to be selectively engaged by respective high-lift lobes of the cam; providing the SRFF with the inner arm disposed between the two outer arms such that the low lift lobe is disposed between the respective high-lift lobes; providing the SRFF inner arm with a roller configured to be selectively engaged by a high-lift lobe of a cam; providing the SRFF outer arm with a sliding pad configured to be selectively engaged by a low-lift lobe of the cam; providing the SRFF with two outer arms each having a sliding pad configured to be selectively engaged by respective low-lift lobes of the cam; providing the SRFF with the inner arm and roller disposed between the two outer arms such that the high-lift lobe is disposed between the respective low-lift lobes; wherein the SRFF roller is provided with a width that is less than a width of the sliding pads such that a width of the high-lift lobe is less than a width of the low-lift lobes; providing the first rocker arm with a first end configured to pivot over a hydraulic lash adjuster; providing the first rocker arm with an opposite second end configured to actuate the first intake valve; providing the switching rocker arm and the fixed rocker arm are for a four valve per cylinder engine, each cylinder including the first intake valve, the second intake valve, a first exhaust valve, and a second exhaust valve; and providing the switching rocker arm and the fixed rocker arm for a three valve per cylinder engine, each cylinder including the first intake valve, the second intake valve, and an exhaust valve.

In another aspect, a valvetrain configuration is provided. The valvetrain configuration includes a first rocker arm configured as a switching rocker arm for a first intake valve, and a second rocker arm configured as a fixed rocker arm for a second intake valve, the second rocker arm operating in a normal Otto cycle mode. The first rocker arm operates in a late intake valve closing (LIVC) mode where the first rocker arm is configured to close the first intake valve later than the second intake valve.

In addition to the foregoing, the described valvetrain configuration may include one or more of the following features: wherein a lash variation of the valvetrain is encountered exclusively during a valve closing event; wherein the first rocker arm provides a low-lift mode and a high-lift mode; wherein the lash variation is provided by a camshaft lash and a latch lash; wherein the camshaft lash is a clearance between a camshaft lobe base circle and the point of the first rocker arm contacts the camshaft lobe, and the latch lash is a clearance between a latch and a latching surface of the first rocker arm; wherein the lash variation is not encountered during a valve opening event; wherein the switching rocker arm is configured as a switching roller finger follower (SRFF); wherein the SRFF is configured for discrete operation in one of a low-lift mode and a high-lift mode; wherein the lash variation is experienced exclusively during the high-lift mode; wherein the low-lift mode corresponds to a power mode and the high-lift mode corresponds to a fuel economy mode; wherein the lash variation of the valvetrain is encountered exclusively during a valve closing event during LIVC mode; wherein the SRFF includes an outer arm and an inner arm; wherein the outer arm is configured to selectively latch to the inner arm; wherein the inner arm is configured to be selectively engaged by a low-lift lobe of a cam; wherein the outer arm includes a sliding pad configured to be selectively engaged by a high-lift lobe of the cam; wherein the outer arm includes two outer arms each having a sliding pad configured to be selectively engaged by respective high-lift lobes of the cam; wherein the inner arm is disposed between the two outer arms such that the low-lift lobe is disposed between the respective high-lift lobes; wherein the inner arm includes a roller configured to be selectively engaged by a high-lift lobe of a cam; wherein the outer arm includes a sliding pad configured to be selectively engaged by a low-lift lobe of the cam; wherein the outer arm includes two outer arms each having a sliding pad configured to be selectively engaged by respective low-lift lobes of the cam; wherein the inner arm and roller are disposed between the two outer arms such that the high-lift lobe is disposed between the respective low-lift lobes; wherein a width of the roller is less than a width of the sliding pads such that a width of the high-lift lobe is less than a width of the low-lift lobes; wherein a first end of the first rocker arm pivots over a hydraulic lash adjuster; wherein an opposite second end of the first rocker arm actuates the first intake valve; wherein the switching rocker arm and the fixed rocker arm are configured for a four valve per cylinder engine, each cylinder including the first intake valve, the second intake valve, a first exhaust valve, and a second exhaust valve; and wherein the switching rocker arm and the fixed rocker arm are configured for a three valve per cylinder engine, each cylinder including the first intake valve, the second intake valve, and an exhaust valve.

In yet another aspect, a valvetrain configuration is provided. The valvetrain configuration includes a first rocker arm configured to be engaged by a cam and configured as a switching rocker arm for a first intake valve, the first rocker arm configured to selectively switch between a normal mode and a late intake valve closing (LIVC) mode, and a second rocker arm configured as a fixed rocker arm for a second intake valve, the second rocker arm operating in a normal Otto cycle mode. In the LIVC mode the first rocker arm is configured to close the first intake valve later than the second intake valve. The first rocker arm is switched from the normal mode to the LIVC mode on a downward slope of the cam such that a LIVC mode valve lift closing is extended relative to a normal mode valve lift closing.

In addition to the foregoing, the described valvetrain configuration may include one or more of the following features: wherein a lost motion between the LIVC mode valve lift closing and the normal mode valve lift closing is between approximately 2 mm and approximately 4 mm; wherein the lost motion is approximately 3 mm; wherein a lost motion between the LIVC mode valve lift closing and the normal mode valve lift closing is between 2 mm and 4 mm; wherein the lost motion is 3 mm; wherein the cam is a single lobe cam; and wherein load is generated only on the decelerating portion of the cam.

In yet another aspect, a method of assembling a valvetrain for an internal combustion engine is provided. The method includes providing a first rocker arm configured to be engaged by a cam and configured as a switching rocker arm for a first intake valve, the first rocker arm configured to selectively switch between a normal mode and a late intake valve closing (LIVC) mode, and providing a second rocker arm configured as a fixed rocker arm for a second intake valve, the second rocker arm operating in a normal Otto cycle mode. In the LIVC mode the first rocker arm is configured to close the first intake valve later than the second intake valve. The first rocker arm is switched from the normal mode to the LIVC mode on a downward slope of the cam such that a LIVC mode valve lift closing is extended relative to a normal mode valve lift closing.

In addition to the foregoing, the described method may include one or more of the following features: providing the first and second rocker arms such that a lost motion between the LIVC mode valve lift closing and the normal mode valve lift closing is between approximately 2 mm and approximately 4 mm; wherein the lost motion is approximately 3 mm; providing the first and second rocker arms such that a lost motion between the LIVC mode valve lift closing and the normal mode valve lift closing is between 2 mm and 4 mm; wherein the lost motion is 3 mm; providing the first rocker arm for a single lobe cam; and providing the first rocker arm such that a load is generated only on the decelerating portion of the cam.

In yet another aspect, a valvetrain configuration is provided. The valvetrain configuration includes a first switching rocker arm for a first intake valve, the first switching rocker arm configured to be engaged by a cam and to selectively switch between a normal mode and an early intake valve closing (EIVC) mode, and a second switching rocker arm for a second intake valve, the second switching rocker arm configured to selectively switch between a normal mode and an early intake valve closing. In the EIVC mode the first switching rocker arm is configured to close the first intake valve later than when the first or second intake valve is closed in the normal mode. The first switching rocker arm is switched from the normal mode to the EIVC mode on a downward slope of the cam such that a EIVC mode valve lift closing is extended relative to a normal mode valve lift closing.

In addition to the foregoing, the described valvetrain configuration may include one or more of the following features: wherein a lost motion between the EIVC mode valve lift closing and the normal mode valve lift closing is between approximately 6 mm and approximately 8 mm; wherein the lost motion is approximately 7 mm; wherein a lost motion between the EIVC mode valve lift closing and the normal mode valve lift closing is between 6 mm and 8 mm; wherein the lost motion is 8 mm; wherein the cam is a single lobe cam; and wherein a maximum lift of the first switching rocker arm in the EIVC mode corresponds to a choke point of the first intake valve.

In yet another aspect, a method of assembling a valvetrain for an internal combustion engine is provided. The method includes providing a first switching rocker arm for a first intake valve, the first switching rocker arm configured to be engaged by a cam and to selectively switch between a normal mode and an early intake valve closing (EIVC) mode, and providing a second switching rocker arm for a second intake valve, the second switching rocker arm configured to selectively switch between a normal mode and an early intake valve closing. In the EIVC mode the first switching rocker arm is configured to close the first intake valve later than when the first or second intake valve is closed in the normal mode. The first switching rocker arm is switched from the normal mode to the EIVC mode on a downward slope of the cam such that a EIVC mode valve lift closing is extended relative to a normal mode valve lift closing.

In addition to the foregoing, the described method may include one or more of the following features: providing the first switching rocker arm such that a lost motion between the EIVC mode valve lift closing and the normal mode valve lift closing is between approximately 6 mm and approximately 8 mm; wherein the lost motion is approximately 7 mm; wherein a lost motion between the EIVC mode valve lift closing and the normal mode valve lift closing is between 6 mm and 8 mm; wherein the lost motion is 8 mm; wherein the cam is a single lobe cam; and providing the first switching rocker arm such that a maximum lift of the first rocker arm in the EIVC mode corresponds to a choke point of the first intake valve.

In yet another aspect, a rocker arm set for a valvetrain is provided. The rocker arm set includes a modular first rocker arm configured as a modular switching rocker arm for a first intake valve, the first rocker arm configured to be selectively engaged by either a first cam or a second cam, the first cam shaped to perform a late intake valve closing (LIVC), and the second cam shaped to perform an early intake valve closing (EIVC), and a second rocker arm for a second intake valve. When the modular first rocker arm is chosen to be engaged by the first cam, the modular first rocker arm operates in a LIVC mode where the modular first rocker arm is configured to close the first intake valve later than the second intake valve. When the modular first rocker arm is chosen to be engaged by the second cam, the modular first rocker arm operates in an EIVC mode where the modular first rocker arm is configured to close the first intake valve earlier than the second intake valve.

In addition to the foregoing, the described rocker arm set may include one or more of the following features: wherein when the modular first rocker arm is chosen to be engaged by the first cam, the second rocker arm is chosen as a fixed rocker arm operating in a normal Otto cycle mode; and wherein when the modular first rocker arm is chosen to be engaged by the second cam, the second rocker arm is chosen as a second modular first rocker arm configured to operate in an early intake valve closing (EIVC) mode.

In yet another aspect, a method of manufacturing a rocker arm set for a valvetrain is provided. The method includes forming a modular first rocker arm configured as a modular switching rocker arm for a first intake valve, the first rocker arm configured to be selectively engaged by either a first cam or a second cam, the first cam shaped to perform a late intake valve closing (LIVC), and the second cam shaped to perform an early intake valve closing (EIVC), and forming a second rocker arm for a second intake valve. When the modular first rocker arm is chosen to be engaged by the first cam, the modular first rocker arm operates in a LIVC mode where the modular first rocker arm is configured to close the first intake valve later than the second intake valve. When the modular first rocker arm is chosen to be engaged by the second cam, the modular first rocker arm operates in an EIVC mode where the modular first rocker arm is configured to close the first intake valve earlier than the second intake valve.

In addition to the foregoing, the described method may include one or more of the following features: wherein when the modular first rocker arm is chosen to be engaged by the first cam, the second rocker arm is formed as a fixed rocker arm operating in a normal Otto cycle mode; and wherein when the modular first rocker arm is chosen to be engaged by the second cam, the second rocker arm is formed as a second modular first rocker arm configured to operate in an early intake valve closing (EIVC) mode.

In yet another aspect, a rocker arm assembly is provided. The rocker arm assembly includes an outer housing, a first pin coupled to the housing, a first rocker arm fixedly mounted to the first pin, the first rocker arm having a first roller rotatably mounted on a first axle extending from the first rocker arm, and a second rocker arm rotatably mounted to the first pin, the second rocker arm having a second roller mounted on a second axle extending from the second rocker arm. The first and second rocker arms of the rocker arm assembly are both configured to interface with a single cam while providing selective and distinct rocker ratios.

In addition to the foregoing, the described rocker arm assembly may include one or more of the following features: wherein the first rocker arm is a standard lift arm and the second rocker arm is a late intake valve closure (LIVC) lift arm; wherein the first and second axles are offset; a latching mechanism that moves between an extended and retracted position, wherein in the retracted position, the LIVC lift arm rotates about the first pin and operates in lost motion and the standard lift arm actuates a valve; wherein the latching mechanism is cantilevered; wherein in the extended position, the cam initially engages the first roller up until a point of change after which the cam urges the second roller therefore rotating the LIVC lift arm through a LIVC event; wherein the standard lift arm has a first rocker ratio and the LIVC arm has a second rocker ratio, wherein the second rocker ratio is smaller than the first rocker ratio; a torsion spring biasing the second axle; wherein the first and second arms are formed of stamped metal; wherein the latching mechanism is actuated by at least one of hydraulically and electrically; wherein the latching mechanism comprises a latch pin that moves along a latch pin bore in a latch pin housing; wherein the latching mechanism comprises a lost motion pin and lost motion spring; wherein the latching mechanism comprises an upper pin having upper fingers, a lower pin having lower fingers, and a spring, wherein during lost motion, the upper fingers and lower fingers are out of alignment allowing the latching mechanism to collapse against the bias of the spring and wherein during actuation, one of the upper and lower pins are rotated such that the upper and lower fingers are aligned for contact; wherein the latching mechanism includes an upper pin and a lower pin biased apart by a spring, the upper pin having one of a male extension portion and a female receiving portion, the lower pin having the other of the male extension portion and female receiving portion, wherein during lost motion, the male extension portion is received by the female receiving portion, in LIVC mode, oil pressure forces the lower pin upward to compress the spring causing the upper and lower pins to act as a solid member; wherein the latching mechanism is actuated by magnetorheological (MR) fluid; wherein the LIVC lift arm rotates through a LIVC event having low lost motion requirements; wherein the LIVC event has a LIVC profile on a deceleration ramp of the single cam; wherein the lost motion is between approximately 3 mm and approximately 4 mm; wherein the first rocker arm is a standard lift arm and the second rocker arm provides one of LIVC, variable valve lift, and cylinder deactivation; wherein the first and second rocker arms of the rocker arm assembly are offset; wherein the first and second rocker arms of the rocker arm assembly are asymmetric; and a second pin coupled to the housing, the first rocker arm fixedly coupled to the second pin.

In one example aspect, a variable lift mechanism for a rocker arm assembly is provided. The variable lift mechanism includes a first cylinder having a first wedge, a second cylinder having a second wedge, and a biasing mechanism disposed between the first and second cylinders. In a first position the first and second wedges are not aligned for contact. In a second position, the first cylinder is rotated relative to the second cylinder such that the first and second wedges are aligned for contact.

In addition to the foregoing, the described variable lift mechanism may include one or more of the following features: wherein in the first position the variable lift mechanism has a first height, and in the second position the variable lift mechanism has a second height different than the first height; wherein the second height is greater than the first height such that the variable lift mechanism is configured to produce a later early closing of an intake valve when in the second position than in the first position; a knob coupled to one of the first and second cylinders, wherein the knob is configured to be manipulated to rotate the first or second cylinder relative to the other of the first and second cylinder; wherein the first wedge is disposed at an angle 'α' and the second wedge is disposed at an angle 'β'; wherein angle 'α' is between approximately 0° and approximately 45°; wherein angle 'β' is between approximately 0° and approximately 45°; and wherein angle 'α' is substantially equal to angle 'β'.

In another example aspect, a valvetrain carrier is provided. The valvetrain carrier includes a carrier body defining a first bore, a pushrod, a rocker arm, and a variable lift mechanism disposed in the first bore and configured to transfer motion from the pushrod to the rocker arm. The variable lift mechanism includes a first cylinder having a first wedge, a second cylinder having a second wedge, and a biasing mechanism disposed between the first and second cylinders. In a first position the first and second wedges are not aligned for contact. In a second position, the first cylinder is rotated relative to the second cylinder such that the first and second wedges are aligned for contact.

In addition to the foregoing, the described valvetrain carrier may include one or more of the following features: wherein in the first position the variable lift mechanism has a first height, and in the second position the variable lift mechanism has a second height different than the first height; wherein the second height is greater than the first height such that the variable lift mechanism is configured to produce a later early closing of an intake valve when in the second position than in the first position; a knob coupled to one of the first and second cylinders, wherein the knob is configured to be manipulated to rotate the first or second cylinder relative to the other of the first and second cylinder; wherein the first wedge is disposed at an angle 'α' and the second wedge is disposed at an angle 'β'; wherein angle 'α' is between approximately 0° and approximately 45°; wherein angle 'β' is between approximately 0° and approximately 45°; and wherein angle 'α' is substantially equal to angle 'β'.

In another example aspect, a method of operating a variable lift mechanism for a rocker arm assembly, the variable lift mechanism including a first cylinder having a first wedge, a second cylinder having a second wedge, and a biasing mechanism disposed between the first and second cylinders. In one example, the method includes moving the first and second cylinders to a first position where the first and second wedges are not aligned for contact, to provide a first variable valve lift, and moving the first and second cylinders to a second position where the first cylinder is rotated relative to the second cylinder such that the first and second wedges are aligned for contact, to provide a second variable valve lift different than the first variable valve lift.

In addition to the foregoing, the described method may include one or more of the following features: moving the first and second cylinders to a third position where the first and second cylinders are spaced apart from each other, to provide a third variable valve lift different than both the first and second variable valve lifts; and wherein the step of moving the first and second cylinders to the third position includes providing a pressurized fluid between the first and second cylinders in order to space apart the first and second cylinders.

DETAILED DESCRIPTION

As will become appreciated from the following discussion, the impact of lash variation on a switching roller finger follower (SRFF) in a discrete variable valve lift (DVVL) valvetrain is reduced from combustion opening and closing event variation to only closing event variation. The number of SRFF's for a DVVL system on a three or four valve per cylinder head is reduced in half. In other words, instead of requiring a SRFF on both intake valves, only one intake valve would be configured with a SRFF. In one implementation, a SRFF valvetrain is provided that switches between normal intake event length and duration (Otto cycle) and late intake valve closing (LIVC) through longer duration (Atkinson cycle). The system and improved results are achieved with one SRFF and one fixed RFF. As such, a set of rockers arms for a valvetrain are provided for a strategy of valve lift with the fixed RFF and SRFF combination, which accounts for the mechanical clearance (lash) on the SRFF and impacts only on the closing event duration on the LIVC event. The opening and closing events on the Otto cycle mode are both set by the fixed RFF.

The cost of such switching valvetrain systems is influenced by the number of valves requiring switching and the tolerances that control the mechanical clearances or lash. Typically, these systems will affect both the intake valve opening timing and the intake valve closing timing. For example, a combustion strategy described as Miller cycle or Atkinson cycle can be achieved by closing the intake valve early or late relative to what is described as Otto cycle. In this way, a DVVL method can be used on intake valves to maximize the performance of an engine configured with early or late intake valve closing (EIVC or LIVC).

Accordingly, some systems described herein utilize a LIVC strategy on one valve of a two-intake valve system (commonly called a 4-valve head with two intake and two exhaust valves per cylinder) combined with a valve lift relationship between the fixed and switching intake valve. This combination is set to minimize the effect of lash variation and to achieve the desired fuel efficiency with fewer switching mechanisms than the current state of the art. This configuration also reduces the effect from lash variation from both intake valve opening and closing to only intake valve closing. In other words, lash variation has no impact during intake valve opening.

Figure 3:
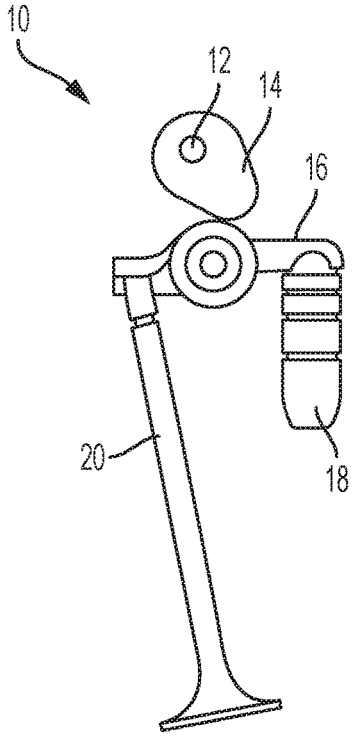
FIG. 3 is side view of a Type II rocker arm assembly according to the present disclosure.

As described herein, the present disclosure provides a system and method of LIVC that is less sensitive to lash. FIG. 3 illustrates a Type II valve train arrangement 10 having a cam shaft 12 with one or more valve actuating lobes 14 located above an engine valve (overhead cam). In a Type II valve train, the overhead cam lobe 14 drives a rocker arm 16, and the first end of the rocker arm pivots over a hydraulic lash adjuster (HLA) 18 while the second end actuates the valve 20.

Figure 4:
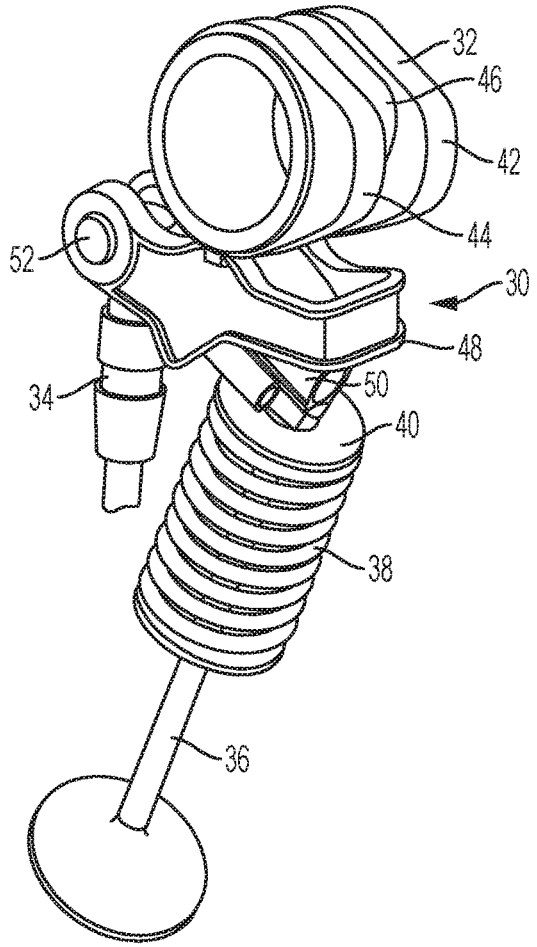
FIG. 4 is a perspective view of an exemplary switching rocker arm assembly according to the present disclosure.

By way of example only, a switching rocker arm assembly 30 is shown in FIG. 4. The exemplary switching rocker arm assembly 30 may be configured for operation with a three lobed cam 32, a lash adjuster 34, a valve 36, a spring 38, and spring retainer 40. The cam 32 has a first and second high-lift lobe 42, 44 and a low-lift lobe 46. The switching rocker arm has an outer arm 48 and an inner arm 50. During high-lift operation, the high-lift lobes 42, 44 contact the outer arm 48 while the low-lift lobe contacts the inner arm 50. The lobes 42, 44, 46 cause periodic downward movement of the outer arm 48 and inner arm 50, and the downward motion is transferred to the valve 36 by inner arm 50, thereby opening the valve 36.

Rocker arm assembly 30 is switchable between a high-lift mode and a low-lift mode. In the high-lift mode, the outer arm 48 is latched to the inner arm 50. During engine operation, the high-lift lobes 42, 44 periodically push the outer arm 48 downward. Because the outer arm 48 is latched to the inner arm 50, the high-lift motion is transferred from outer arm 48 to inner arm 50 and further to the valve 36.

When the rocker arm assembly 30 is in low-lift mode, the outer arm 48 is not latched to the inner arm 50, and so high-lift movement exhibited by the outer arm 48 is not transferred to the inner arm 50. Instead, the low-lift lobe 46 contacts the inner arm 50 and generates low-lift motion that is transferred to the valve 36. When unlatched from inner arm 50, the outer arm 48 pivots about a pivot axle 52, but does not transfer motion to valve 36. Again, the switching rocker arm assembly 30 is merely exemplary and other switching rocker arms may be provided within the scope of the present disclosure.

Figure 5:
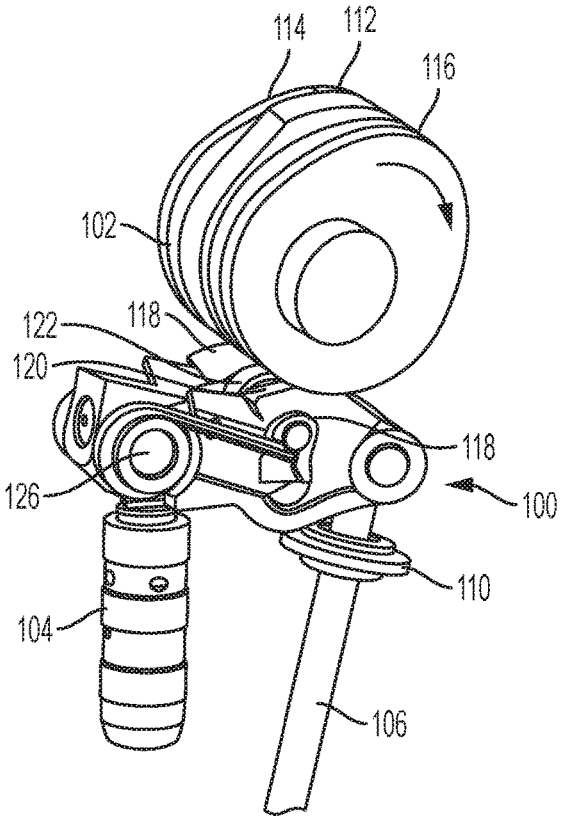
FIG. 5 is a perspective view of another exemplary switching rocker arm assembly according to the present disclosure.
Figure 6:
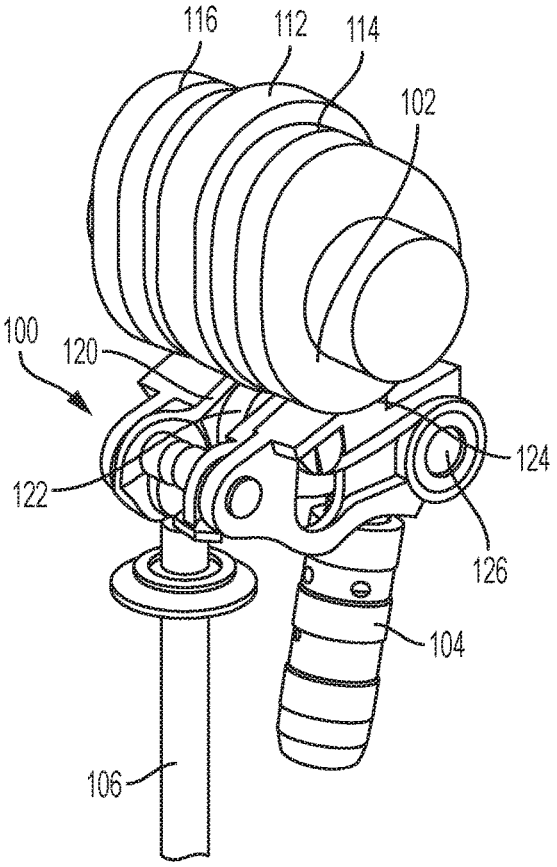
FIG. 6 is another perspective view of the switching rocker arm assembly shown in FIG. 5.
Figure 7:
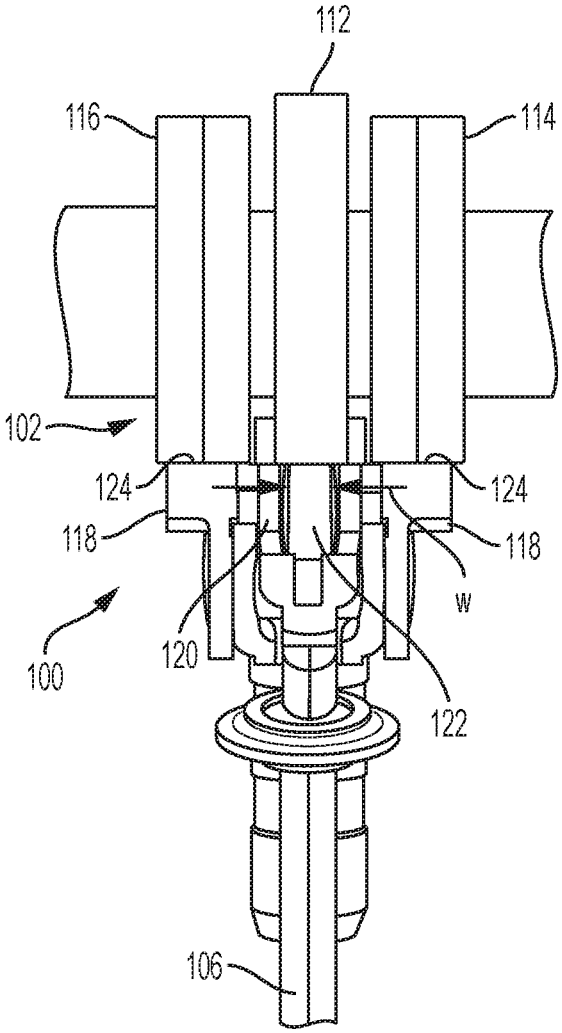
FIG. 7 is a front view of the switching rocker arm assembly shown in FIG. 5.

By way of another example, a switching rocker arm assembly 100 is shown in FIGS. 5-7. The exemplary switching rocker arm assembly 100 may be configured during operation with a three lobed cam 102, a lash adjuster 104, a valve 106, spring (not shown), and a spring retainer 110. The cam 102 has a high-lift lobe 112, and first and second low-lift lobes 114, 116. The switching rocker arm has a pair of outer arms 118 and an inner arm 120. During high-lift operation, the high-lift lobe 112 contacts the inner arm 120, for example, via a roller 122. In this way, the high lift event occurs on the rolling element 122, which reduces friction compared to contact with sliders 124 of the outer arm 118. During low-lift operation, the low-lift lobes 114, 116 contact the outer arms 118. The lobes cause periodic downward movement of the outer arms 118 and inner arm 120. The downward motion is transferred to the valve 106 by inner arm 120 and/or outer arm 118, thereby opening the valve.

Rocker arm assembly 100 is switchable between a high-lift mode and a low-lift mode. In the low-lift mode, the outer arm 118 is latched to the inner arm 120. During engine operation, the low-lift lobes 114, 116 periodically push the outer arm 118 downward. Because the outer arm 118 is latched to the inner arm 120, the low-lift motion is transferred from outer arm 118 to inner arm 120 and further to the valve 106.

When the rocker arm assembly 100 is in the high-lift mode, the outer arm 118 is not latched to the inner arm 120, and so any low-lift movement exhibited by the outer arm 118 is not transferred to the inner arm 120. Instead, the high-lift lobe 112 contacts the roller 122 of inner arm 120 and generates high-lift motion that is transferred to the valve 106. Accordingly, friction is reduced during the high-lift mode because high-lift lobe 112 contacts roller 122, which provides a contact surface friction lower than sliding surfaces on the outer arms 118. When unlatched from inner arm 120, the outer arm 118 pivots about a pivot axle 126, but does not transfer motion to valve 106. Moreover, as shown in FIG. 7, switching rocker arm assembly 100 may include a narrow roller 122 (e.g., 5.5 mm width 'w') compared to previously known rollers (e.g., 10.5 mm width), which reduces cost and friction, and provides a more compact design. In other examples, low-lift motion is transferred to outer arms 118 and to valve 106, and high-lift motion may be transferred to inner arm 120 via latching to outer arm 118 and then to valve 106. Again, the switching rocker arm assembly 100 is merely exemplary and other switching rocker arms may be provided within the scope of the present disclosure.

In this way, optimized fuel economy can be targeted during LIVC and in doing so a rolling element 122 can be implemented to carry the load of the valve lifting to minimize frictional losses to the engine. To that end, a SRFF can be provided in which the higher event (LIVC) valve lift load is carried by the roller 122 and the normal event for power mode is carried by the sliders 124 on outer arms 118. This is accomplished by reversing the lost motion arm and moving it from the outer arm to the inner arm. The outer arm 118 can be similar to the arm found in a SRFF cylinder deactivation arm but modified to have a narrower bearing width. Moreover, the outer arm can incorporate sliding pads 124 that can be designed into the outer arms 118.

Figure 8:
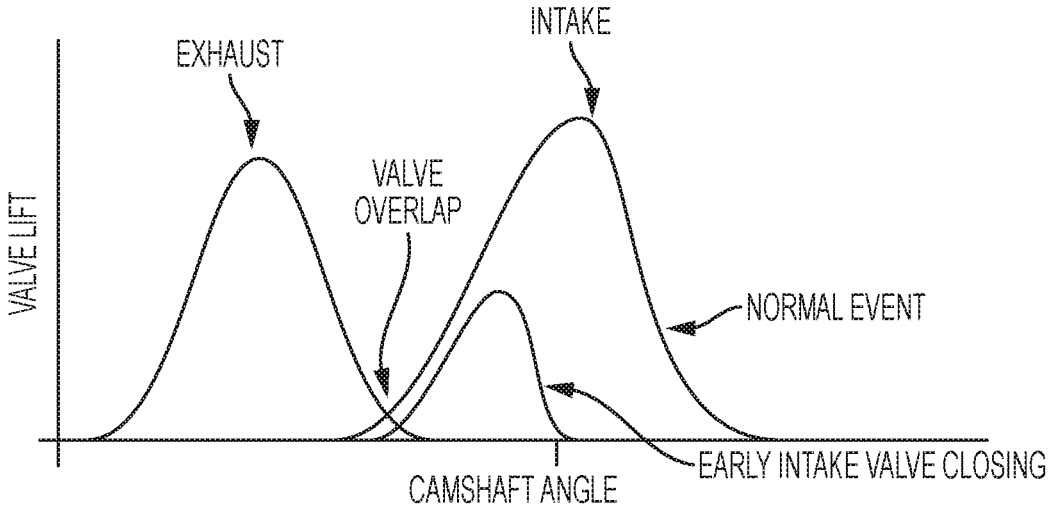
FIG. 8 is a plot illustrating an example early intake valve closure event according to the present disclosure.
Figure 9:
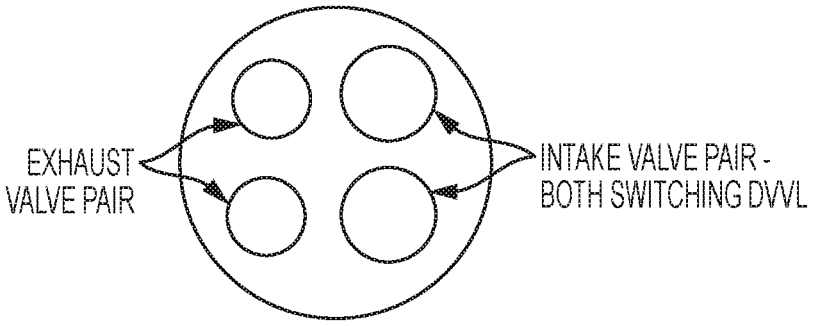
FIG. 9 is a plan view of an example cylinder layout including an exhaust valve pair and an intake valve pair having the intake valve pair both configured as switching DVVL rocker arms according to the present disclosure.

With reference now to FIGS. 8 and 9, an early intake valve closing (EIVC) event is shown for a four valve per cylinder engine. It is appreciated that the same may be used for a three valve per cylinder engine (only one exhaust valve). In sum, at least a portion of the present disclosure is predicated on a configuration that uses two intake valves per cylinder. One example of WA technology used to alter operation and improve fuel economy in Type II gasoline engines is discrete variable valve lift (DVVL), also sometimes referred to as a DVVL switching rocker arm. DVVL works by limiting the engine cylinder intake air flow with an engine valve that uses discrete valve lift states versus standard "part throttling".

Figure 10:
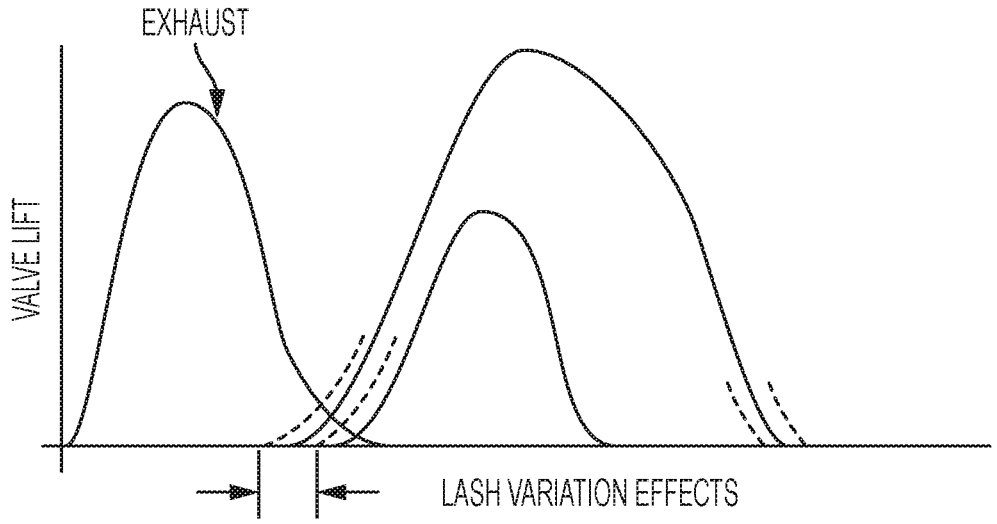
FIG. 10 is a plot illustrating early intake valve closing (EIVC) using the configuration in FIG. 9 and showing lash variation affecting the start of gas flow at the valve overlap area and at closing on the high-lift event according to the present disclosure.

Currently, a switching rocker arm assembly (such as the switching rocker arm assembly 30 described above) for an EIVC is configured on both intake valves (FIGS. 9 and 10). One assumption on the combustion model is that both intake valves are synchronized to control the flow of gases (air) relative to the piston position or camshaft angle. This requirement introduces a high level of variation and drives tight control of lash. Implementing EIVC on two switching DVVL requires high level of precision in manufacturing and wear characteristics throughout the life of the engine.

Figure 11:
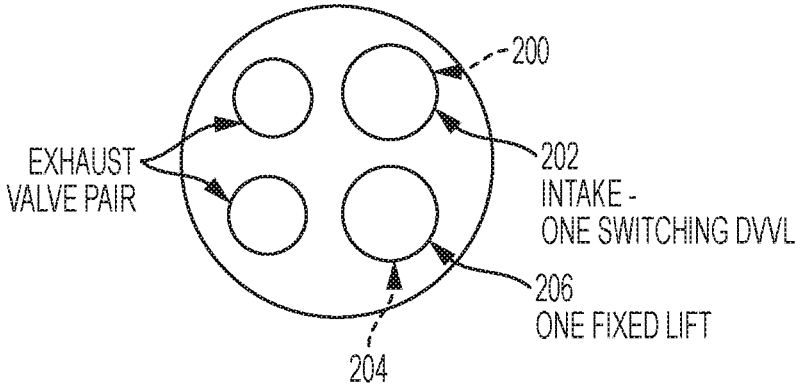
FIG. 11 is a plan view of an example cylinder layout including an exhaust valve pair and an intake valve pair having a first intake valve configured with a switching DVVL rocker arm and a second intake valve configured as a fixed rocker arm according to the present disclosure.
Figure 12:
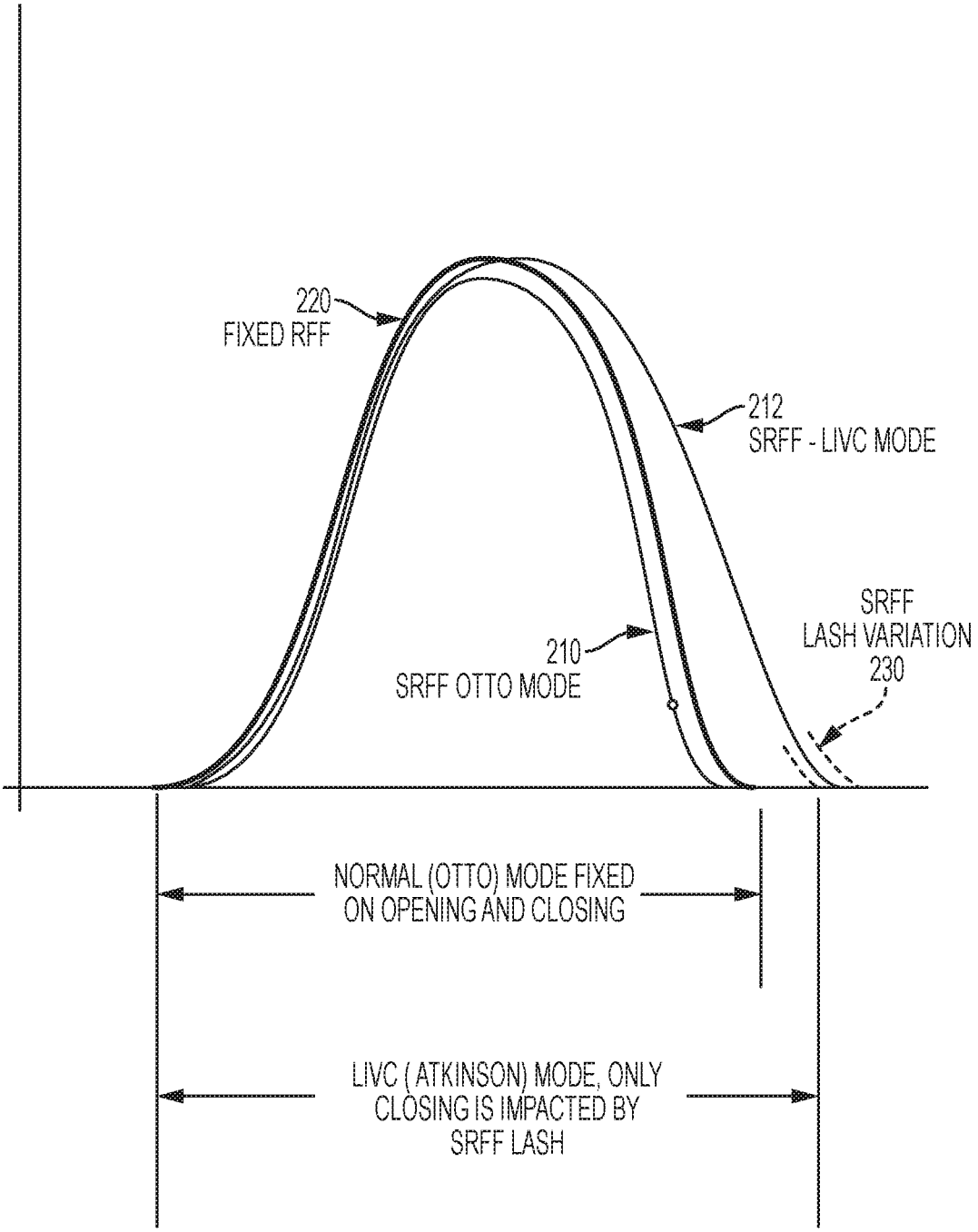
FIG. 12 is a plot illustrating example intake valve events from the first and second rocker arms of FIG. 11.

According to one example of the present disclosure shown in FIG. 11, one rocker arm is implemented as a switching rocker arm 200 on a first intake valve 202 and configured as a LIVC. The other rocker arm is configured as a fixed rocker arm 204 fixed on a second intake valve 206. Turning to FIG. 12, the switching rocker arm 200 is labeled as SRFF (switching roller finger follower) in the base Otto mode along line 210. The switching rocker arm 200 is labeled as SRFF in a LIVC mode along line 212. In this regard, the configuration provides a low-lift mode 210 (power mode) and a high-lift mode 212 (fuel economy mode) described above. Also identified is the fixed rocker arm 204, labeled as a Fixed RFF (roller finger follower) line 220.

As shown, the low-lift mode 210 has a similar profile as the fixed RFF profile 220. Lash variation is identified at 230. As shown, only closing is impacted by SRFF lash in LIVC mode 212. In other words, lash variation 230 does not "cross" the fixed RFF path 220, and no variation is encountered on the valve opening event. Lash variation 230 is only encountered on valve closing event LIVC 212 and not during the power mode, and thus impact of lash variation is reduced in half. Moreover, it is exposed only in the SRFF in LIVC mode 212. In addition, the configuration of the present disclosure has less impact on the combustion cycle as it only affects the intake valve closure on the LIVC portion.

As described herein, the present disclosure provides a DVVL valvetrain configuration that only requires a single SRFF and a single fixed RFF for each intake valve pair in an LIVC configuration, thereby improving engine efficiency. Further, by designing the SRFF to have low lost motion, low cam load, and low stress, manufacturing cost is reduced and SRFF durability and life are improved.

Figure 13:
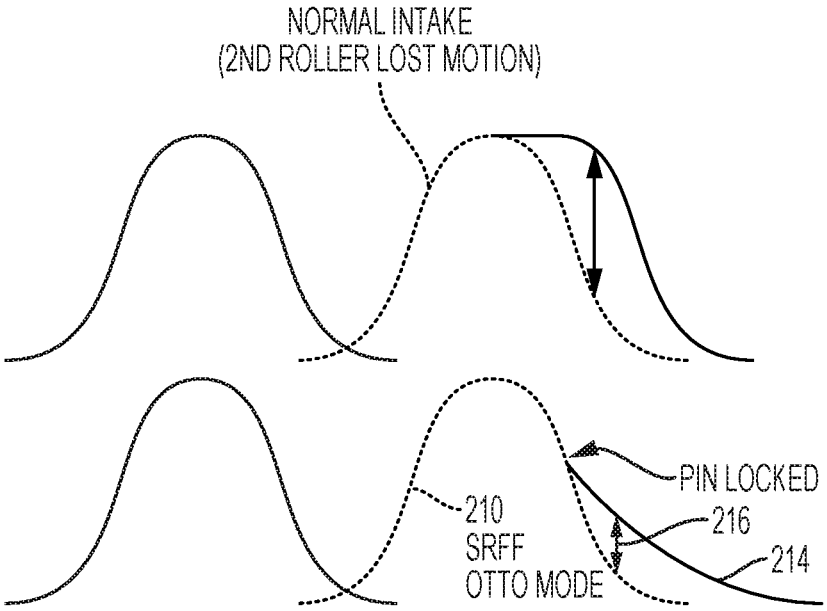
FIG. 13 is a plot illustrating an example late intake valve closing (LIVC) using a modular switching rocker arm assembly in the FIG. 11 configuration and showing the difference in lost motion between a normal closing and LIVC according to the present disclosure.

In another example of the present disclosure shown in FIG. 11, switching rocker arm 200 may be operated differently than shown in FIG. 12. Turning to FIG. 13, the switching rocker arm 200 is labeled as SRFF in the base Otto mode along line 210. The switching rocker arm 200 is labeled as SRFF in a LIVC mode along line 214. However, unlike the SRFF in LIVC mode shown as line 212 in FIG. 12, in this configuration, a latching mechanism (e.g., as described herein throughout) of switching rocker arm 200 is engaged on the downward slope of the cam such that the valve lift closing is extended (line 214) relative to the standard valve lift (line 210).

In this way, the configuration of FIG. 13 only generates between 2 mm and 4 mm (or between approximately 2 mm and approximately 4 mm) of lost motion, shown by distance 216. Moreover, load is generated only on the lowest or decelerating portion of the cam, thereby reducing overall load. Additionally, as shown in FIG. 13, the downward slope of line 214 is more gradual than the downward slope of line 210, which improves valve durability because the valve is gradually closing. Further, this operation can be accomplished with only a single lobe cam, thereby reducing number of parts and cost. However, the operation is not so limited and may be utilized with double and triple lobe cam configurations, for example, as described herein. In some configurations, a single lobe cam setup will require offset rollers, whereas a triple lobe cam setup may use rollers that are not offset.

In further aspects, the present disclosure provides a rocker arm set including a modular SRFF switching rocker arm assembly that may be adapted for both EIVC and LIVC mode operations. This is unlike traditional DVVL systems, which require different rocker arm assemblies depending on whether EIVC or LIVC is desired. As such, at least one modular switching rocker arm assembly is provided for each intake valve pair, and then the DVVL is subsequently conformed to provide a desired function of the SRFF. More specifically, the at least one SRFF is provided in the DVVL and can then be utilized to perform either EIVC or LIVC by providing a cam lift profile specifically shaped or designed to produce the desired EIVC or LIVC valve profile. In this way, only one modular SRFF rocker arm configuration is required to customize the DVVL operation for either EIVC or LIVC.

If LIVC operation is desired, only a single SRFF (along with a fixed RFF) is required on the intake valve 202, 206. If EIVC operation is desired, two modular SRFF's are provided, one for each intake valve 202, 206. However, since the same modular SRFF rocker arm assembly may be utilized for both of EIVC and LIVC, there is no longer a need for two separately manufactured SRFF's as required in the traditional DVVL systems, and costs are greatly reduced.

Figure 14:
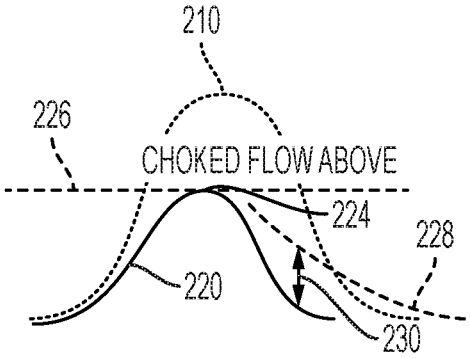
FIG. 14 is a plot illustrating an example EIVC using a modular switching rocker arm assembly in the FIG. 11 configuration and showing the difference in lost motion between a normal closing and EIVC according to the present disclosure.

Turning to FIGS. 13 and 14, example valve timings of the modular SRFF are illustrated. Specifically, FIG. 13 illustrates one example of the modular SRFF operating in LIVC mode, while FIG. 14 illustrates one example of the modular SRFF operating in EIVC mode. In particular, FIG. 14 shows a base Otto mode along line 210, with a switching rocker arm 200 labeled as SRFF in an EIVC mode along line 220. In the EIVC to normal switching configuration shown in FIG. 14, the cam profile is generated such that the maximum lift 224 of the SRFF corresponds to (or approximately) to the point the valve port is choked, which is less than maximum valve lift and illustrated by line 226. Thus, by matching the maximum lift 224 to the valve port choke 226, the valve is not lifted past a point where additional valve lift will not result in any more flow. Accordingly, the described system provides flow equivalent to previously known systems but with dramatically lower lift, which enables reduced packaging and increased system stability.

Moreover, in this configuration, a latching mechanism (e.g., as described herein throughout) of switching rocker arm 200 is engaged on the downward slope of the cam such that the valve lift closing is extended (line 228) (i.e., closes later than) relative to the standard valve lift (line 210). In this way, the configuration only generates between 6 mm and 8 mm (or between approximately 6 mm and approximately 8 mm) of lost motion, shown by distance 230. In other examples, distance 230 is 3 mm or approximately 3 mm. In this configuration, load is generated only on the lowest or decelerating portion of the cam, thereby reducing overall load. Additionally, as shown in FIG. 14, the downward slope of line 228 is more gradual than the downward slope of lines 210 and 220, which improves valve durability in part because impact is reduced. Further, such an operation can be accomplished with a single lobe cam, thereby reducing number of parts and cost. However, the operation is not so limited and may be utilized with double and triple lobe cam configurations, for example, as described herein. In some configurations, a single lobe cam setup will require offset rollers, whereas a triple lobe cam setup may use rollers that are not offset.

With reference now to FIGS. 15-26, the present disclosure further provides a double roller switching roller finger follower (SRFF) for switchable normal and LIVC profiles. It will be appreciated that while LIVC profiles are described herein, the same features may be applicable to variable valve lift and/or cylinder deactivation. The present disclosure provides a double roller VVL device that provides simpler parts and a smaller width as a result of only two rollers used without traditional sliders.

With specific reference to FIGS. 15A-15C, a dual roller switching roller finger follower 300 will now be described. The dual roller switching roller finger follower 300 includes an outer housing 312, a standard lift arm 316, and a late intake valve closure (LIVC) lift arm 320. The standard lift arm 316 is fixedly mounted to a first pin 322 and a second pin 324. The first and second pins 322 and 324 are fixed to the outer housing 312. A first roller 330 is rotatably mounted to the standard lift arm 316 on a first axle 332, and a second roller 340 is rotatably mounted to the LIVC lift arm 320 on a second axle 342. As shown in FIG. 15C, the first and second axles 332 and 342 are offset, and the LIVC lift arm 320 is permitted to rotate about the first pin 322.

Figure 15A:
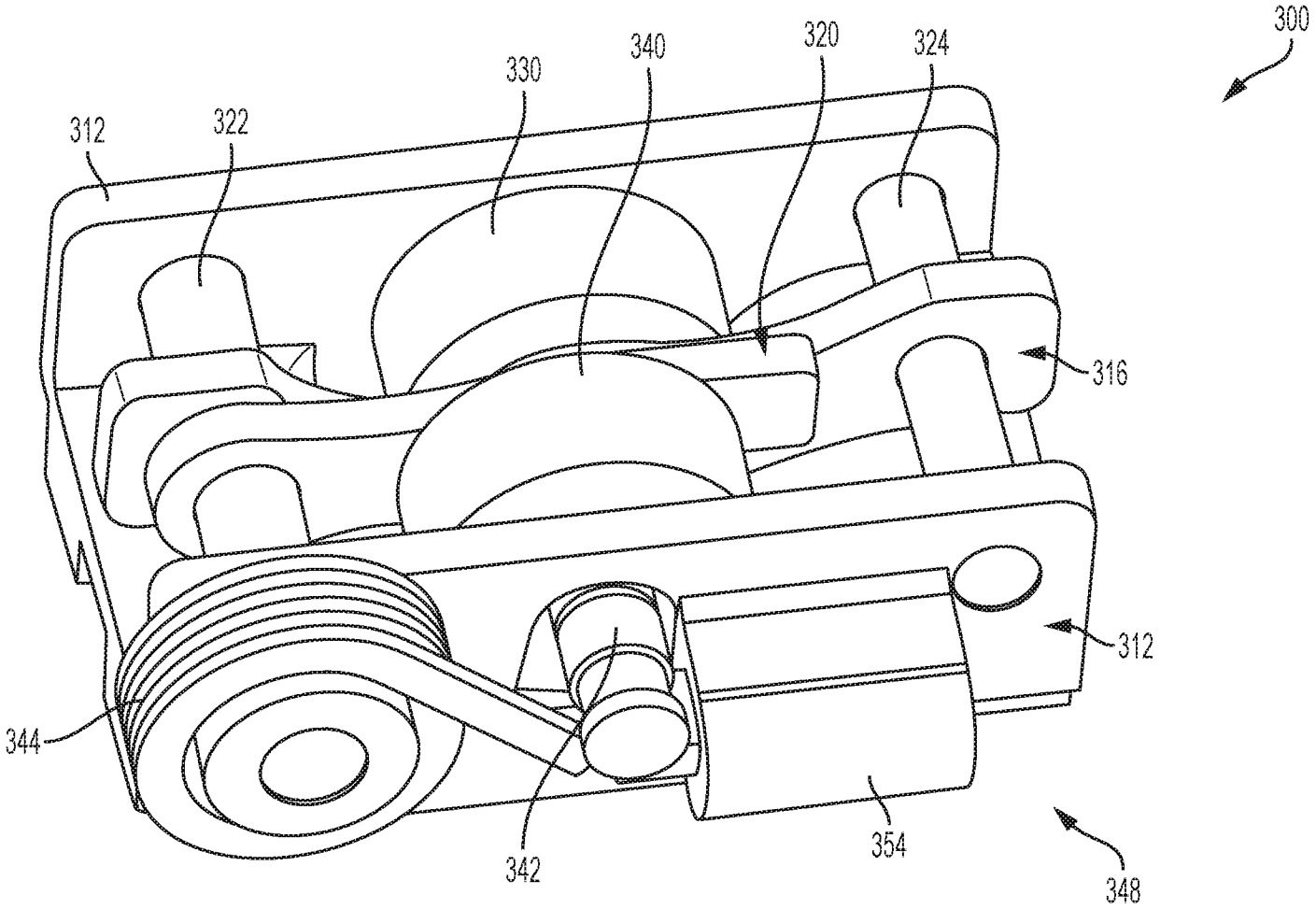
FIG. 15A is a perspective view of a dual roller switching roller finger follower assembly according to one example of the present disclosure.

A single biasing mechanism (e.g., torsion spring) 344 is mounted around a torsion spring retainer 346 and includes a first end that biases the second axle 342 in an upward position as viewed in FIG. 15A. A latching mechanism 348 includes a latch pin 350 that moves between an extended position and a retracted position relative to a latch pin bore 352 in a latch pin housing 354.

In the extended position (FIG. 15B), the latch pin 350 keeps the second roller 340 in an upward position (and in contact with a single cam 358). In one example, the standard lift arm 316 and the LIVC lift arm 320 can be formed of stampings. Further, the latching mechanism 348 and the torsion spring 344 are cantilevered relative to the outer housing 312, and the latching mechanism 348 can be actuated hydraulically, electrically, or by other actuation configurations and combinations thereof.

Operation of the dual roller switching roller finger follower 300 shown in FIGS. 15A-15C will now be described. In normal mode, the standard lift arm 316 is engaged by the cam 358 via roller 330 and rotates to actuate valve 360 (FIG. 15B). During normal mode, the LIVC arm 320 operates in lost motion where that motion is taken up by the torsion spring 344 as the latch pin 350 is disengaged (retracted).

In LIVC mode, cam 358 is initially in contact with the standard arm (first) roller 330 up until a point of change 362 (see FIG. 18) after which the cam 358 then pushes the LIVC arm (second) roller 340 thus achieving the added LIVC event. The LIVC is achieved as the LIVC arm 320 has a smaller rocker ratio as compared to the standard lift arm 316. As described herein in more detail (e.g., FIGS. 27-34), the rocker ratio is the geometric ratio of cam lift to valve lift. In this way, the lost motion only requires approximately 3 mm to approximately 4 mm of motion (or 3 mm to 4 mm), as the second roller 40 is positioned closer to the valve than previously known systems.

Figure 15B:
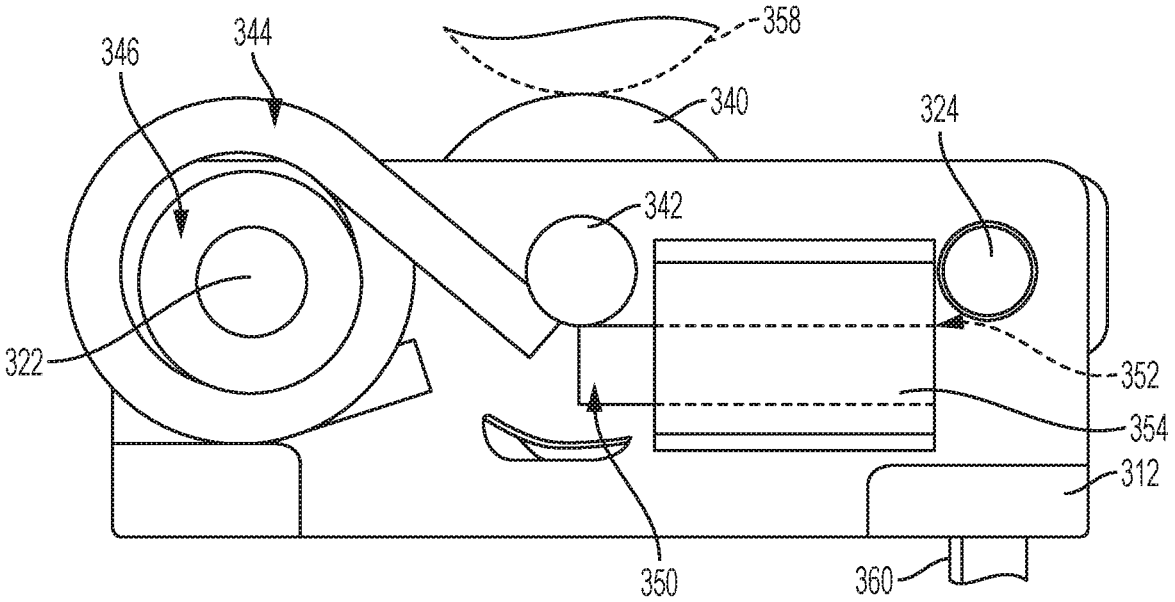
FIG. 15B is a side view of the assembly shown in FIG. 15A.
Figure 15C:
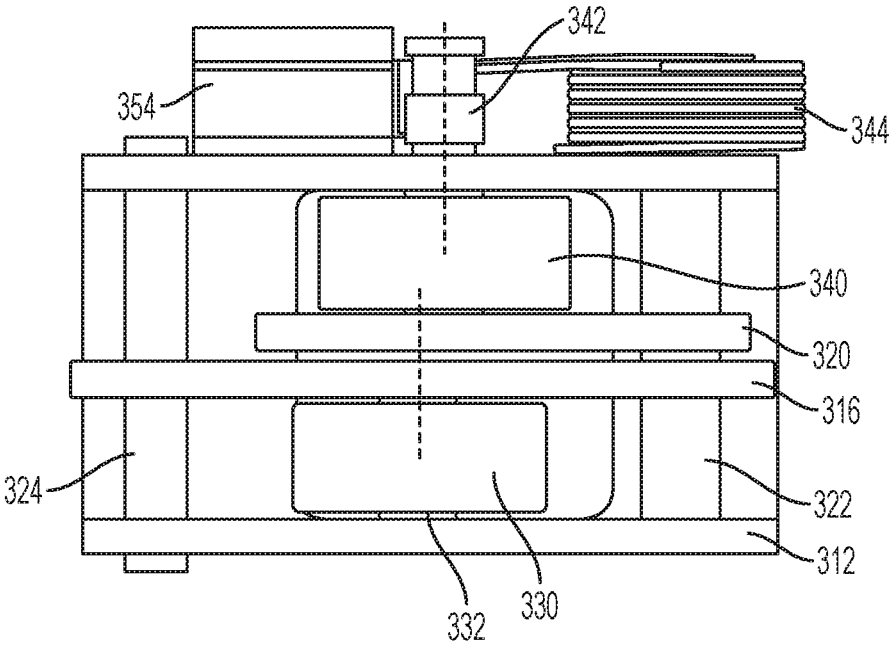
FIG. 15C is a top view of the assembly shown in FIG. 15A.
Figure 16:
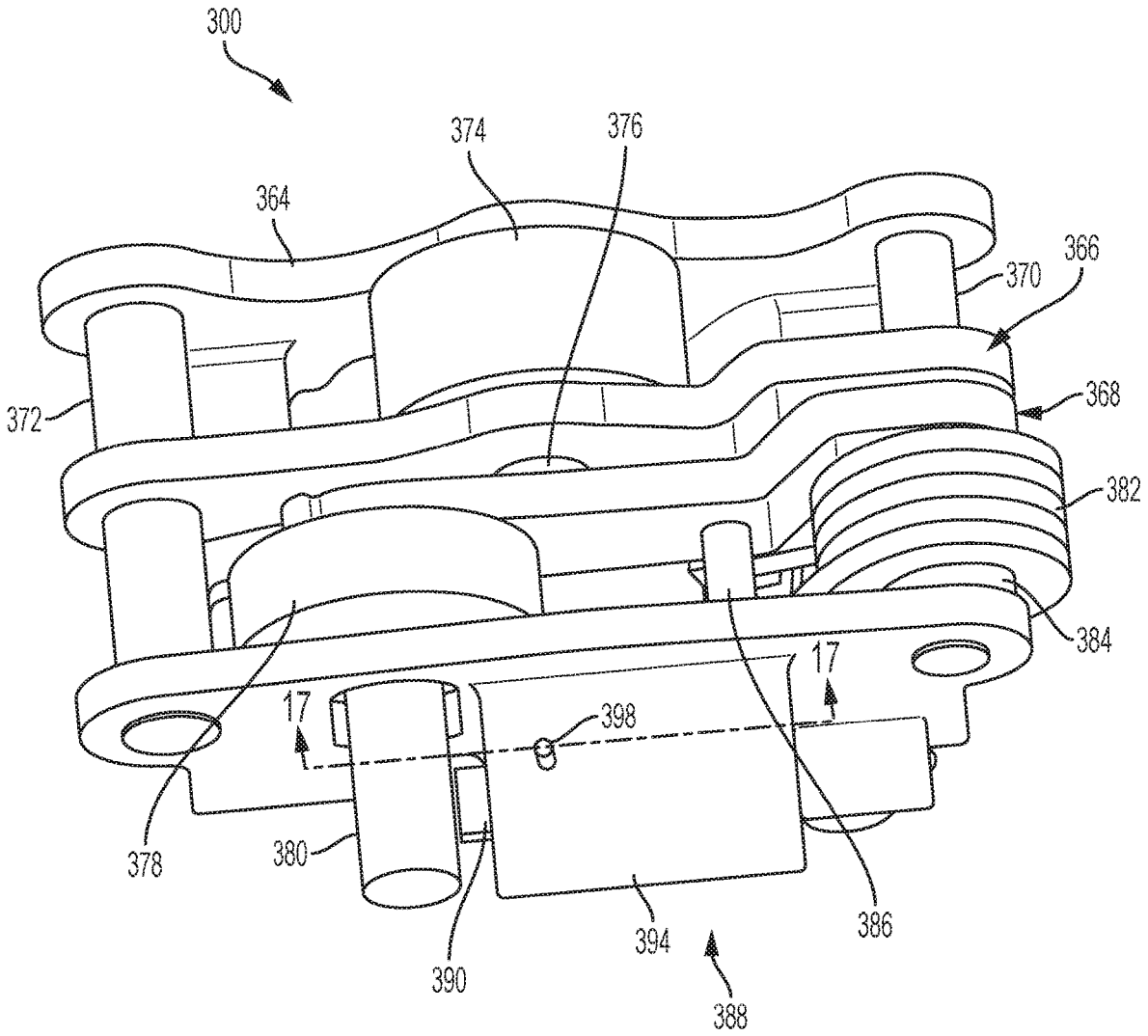
FIG. 16 is a perspective view of a dual roller switching roller finger follower assembly according to another example of the present disclosure.
Figure 17:
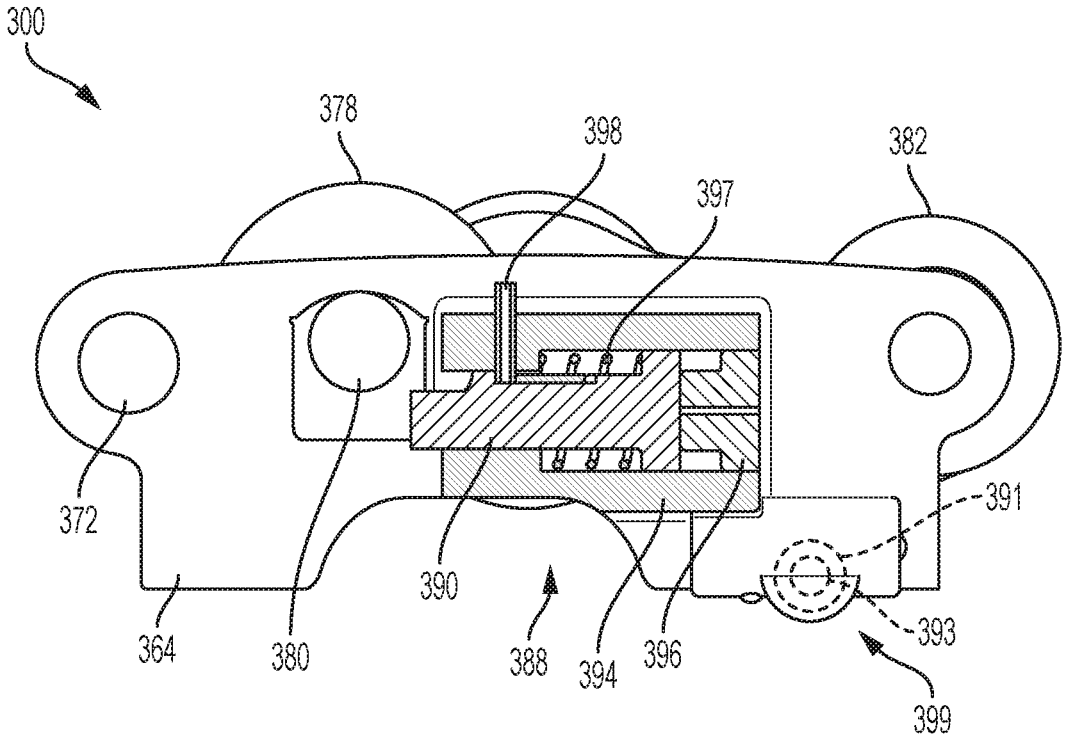
FIG. 17 is a side sectional view of the assembly shown in FIG. 16 and taken along line 17-17.
Figure 18:
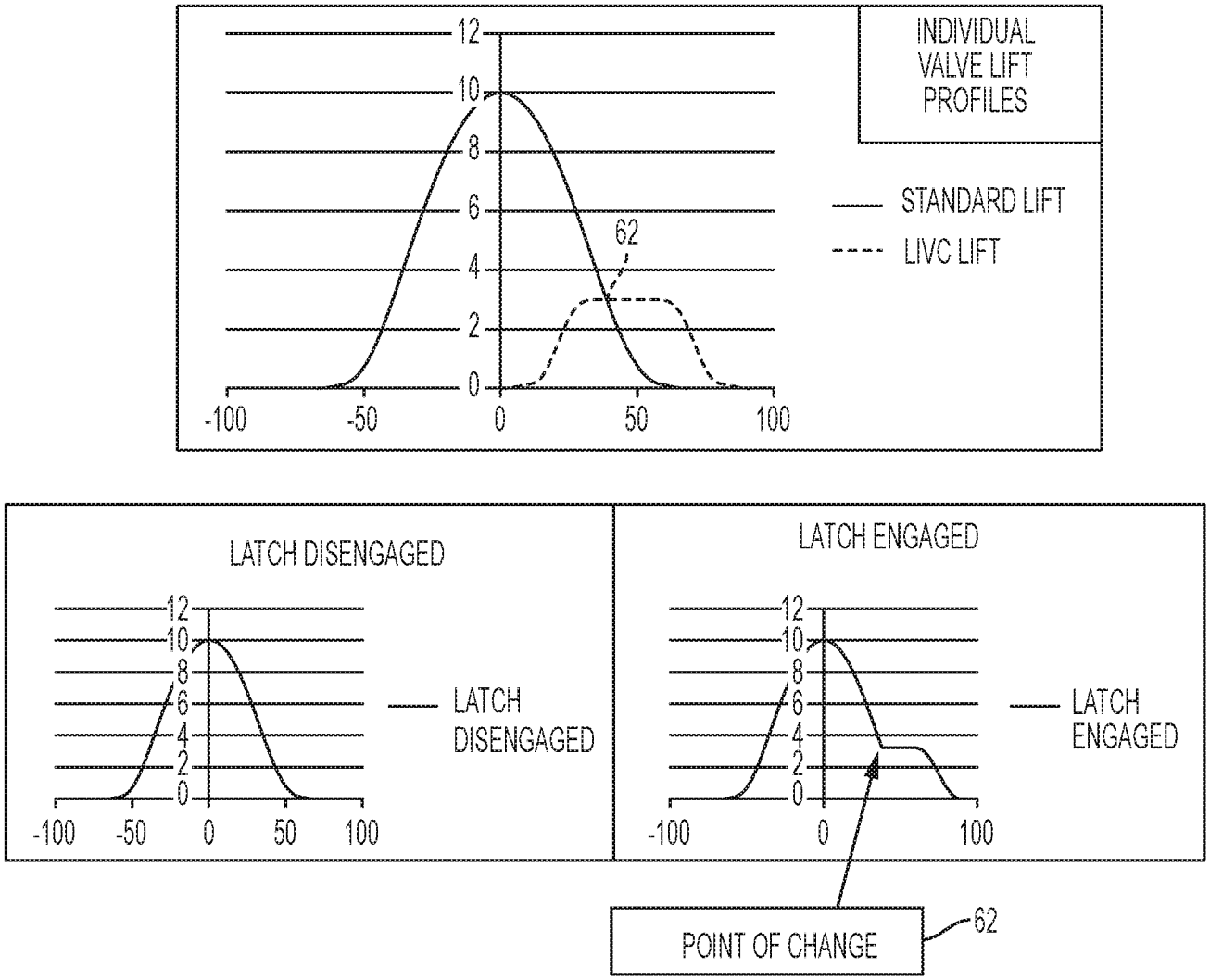
FIG. 18 illustrates standard lift arm and LIVC lift arm profiles accomplished using a single lobe cam and offset rollers according to examples of the present disclosure.

The dual roller switching roller finger follower shown in FIGS. 15A-15C is illustrated in an alternative arrangement in FIGS. 16 and 17. As illustrated in FIGS. 16 and 17, dual roller switching roller finger follower 300 includes an outer housing 364, a standard lift arm 366, and a late intake valve closure (LIVC) lift arm 368. The standard lift arm 366 is fixedly mounted to a first pin 370 and a second pin 372. The first and second pins 370, 372 are fixed to the outer housing 364. A first roller 374 is rotatably mounted to the standard lift arm 366 on a first axle 376, and a second roller 378 is rotatably mounted to the LIVC lift arm 368 on a second axle 380. As shown in FIG. 16, the first and second axles 376, 380 are offset, and the LIVC lift arm 368 is permitted to rotate about the first pin 370.

A single biasing mechanism (e.g., torsion spring) 382 is mounted around a torsion spring retainer 384 and includes a first end disposed against a pin 386 coupled to LIVC lift arm 368 to bias LIVC lift arm 368 in an upward position as viewed in FIG. 16.

As shown in FIG. 17, a latching mechanism 388 includes a latch pin 390 that moves between an extended position and a retracted position relative to a latch pin bore 392 in a latch pin housing 394. In addition, the latching mechanism 388 includes a latch cage 396, a biasing mechanism 397, and a latch anti-rotation pin 398 configured to facilitate preventing rotation of latch pin 390 within latch pin housing 394. Latch cage 396 is configured to provide a stop and define a maximum retracted distance for latch pin 390 within latch pin housing 394. As shown, latch anti-rotation pin 398 interfaces with a slot formed in latch pin 390, thereby constraining the oscillation of latch pin 390 in latch pin housing 394. In one example, the outer housing 364 can include a portion 399 defining a transverse bore 391 extending parallel to or generally parallel to the first pin 370. The transverse bore 391 can receive a second anti-rotation pin 393 which can be received in an aperture on either the cylinder head or a hydraulic lash adjuster (not shown) to constrain the transverse oscillation of the outer housing 364.

In the extended position (not shown), the latch pin 390 keeps the second roller 378 in an upward position and in contact with a single cam (e.g., 358). In one example, the standard lift arm 364 and the LIVC lift arm 368 can be formed of stampings. Further, the latching mechanism 388 can be actuated hydraulically, electrically, or by other actuation configurations and combinations thereof.

Operation of the dual roller switching roller finger follower 300 shown in FIGS. 16 and 17 will now be described. In normal mode, the standard lift arm 366 is engaged by the cam (e.g., 358) via roller 374 and rotates to actuate a valve (e.g., 360). During normal mode, the LIVC arm 368 operates in lost motion where that motion is taken up by the torsion spring 382 as the latch pin 390 is disengaged (retracted).

In LIVC mode, the cam (e.g., 358) is initially in contact with the standard arm (first) roller 374 up until the point of change 362 (see FIG. 18) after which the cam then pushes the LIVC arm (second) roller 378 thus achieving the added LIVC event. The LIVC is achieved as the LIVC arm 368 has a smaller rocker ratio as compared to the standard lift arm 366.

Figure 19:
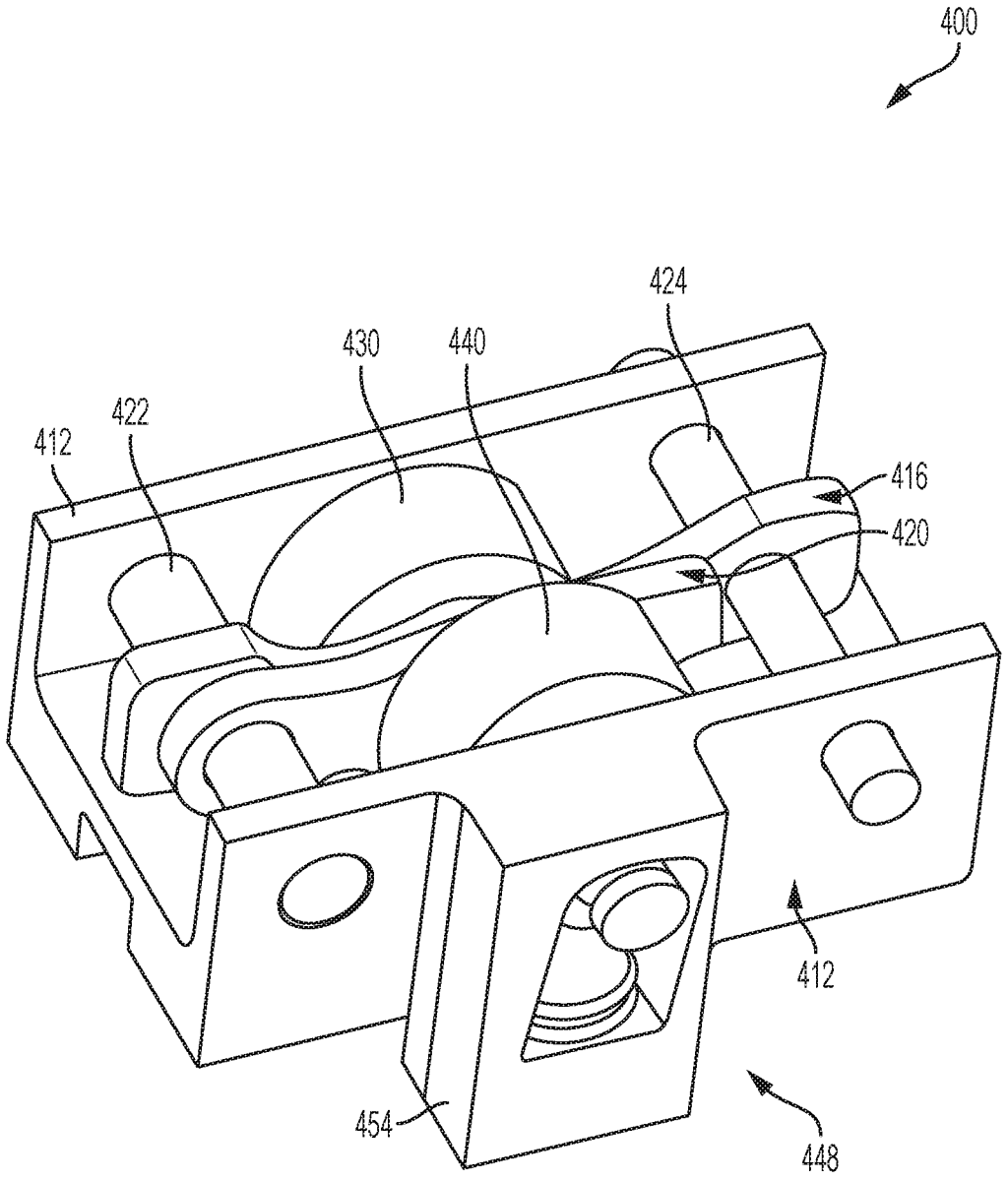
FIG. 19 is a perspective view of a dual roller switching roller finger follower assembly according to another example of the present disclosure.
Figure 20:
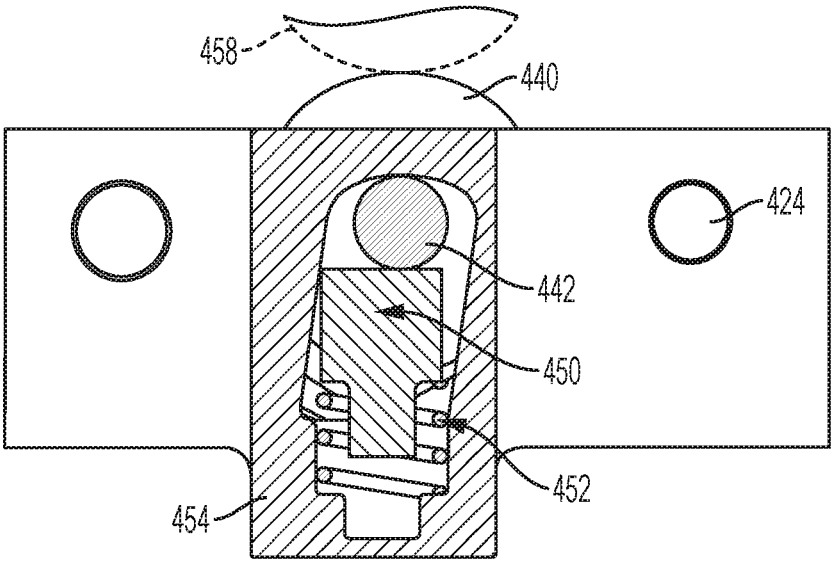
FIG. 20 is a side view of the assembly shown in FIG. 19.
Figure 21:
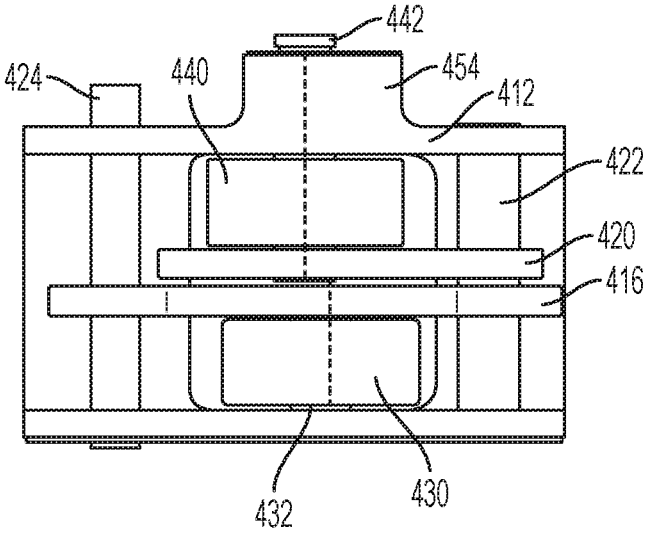
FIG. 21 is a top view of the assembly shown in FIG. 19.

With reference to FIGS. 19-21, a dual roller switching roller finger follower assembly 400 will now be described. The dual roller switching roller finger follower assembly 400 includes an outer housing 412, a standard lift arm 416, and a late intake valve closure (LIVC) lift arm 420. The standard lift arm 416 is fixedly mounted to a first pin 422 and a second pin 424. A first roller 430 is rotatably mounted to the standard lift arm 416 on a first axle 432, and a second roller 440 is rotatably mounted to the LIVC lift arm 420 to a second axle 442. As shown in FIG. 21, the first and second axles 432 and 442 are offset, and the LIVC lift arm 420 is permitted to rotate about the first pin 422.

A latching mechanism 448 includes a lost motion pin 450 that is biased by a lost motion biasing mechanism (e.g., spring) 452 to move between an extended position and a retracted position relative to the second axle 442 in a pin housing portion 454 formed in the outer housing 412. In the extended position (FIG. 20), the lost motion pin 450 keeps the second roller 440 in an upward position (and in contact with a single cam 458). In one example, the standard lift arm 416 and the LIVC lift arm 420 can be formed of stampings. Further, the latching mechanism 448 can be actuated hydraulically, electrically, electromagnetically, or by other actuation configurations and combinations thereof. In this regard, the lost motion pin 450 can be made to avoid lost motion and act as a solid entity by electromagnetic means, hydraulic means, or any other suitable means.

Operation of the dual roller switching roller finger follower assembly 400 will now be described. In normal mode, the standard lift arm 416 is engaged by the cam 458 via roller 430 and rotates to actuate a valve (e.g., valve 36). During normal mode, the LIVC arm 420 operates in lost motion where that motion is taken up by the lost motion spring 452.

In LIVC mode, cam 458 is initially in contact with the standard arm (first) roller 430 up until a point of change 62 (FIG. 18) after which the cam 458 then pushes the LIVC arm (second) roller 440 thus achieving the added LIVC event. In this way, the LIVC is achieved as the LIVC arm 420 has a smaller rocker ratio as compared to the standard lift arm 416.

Figure 22:
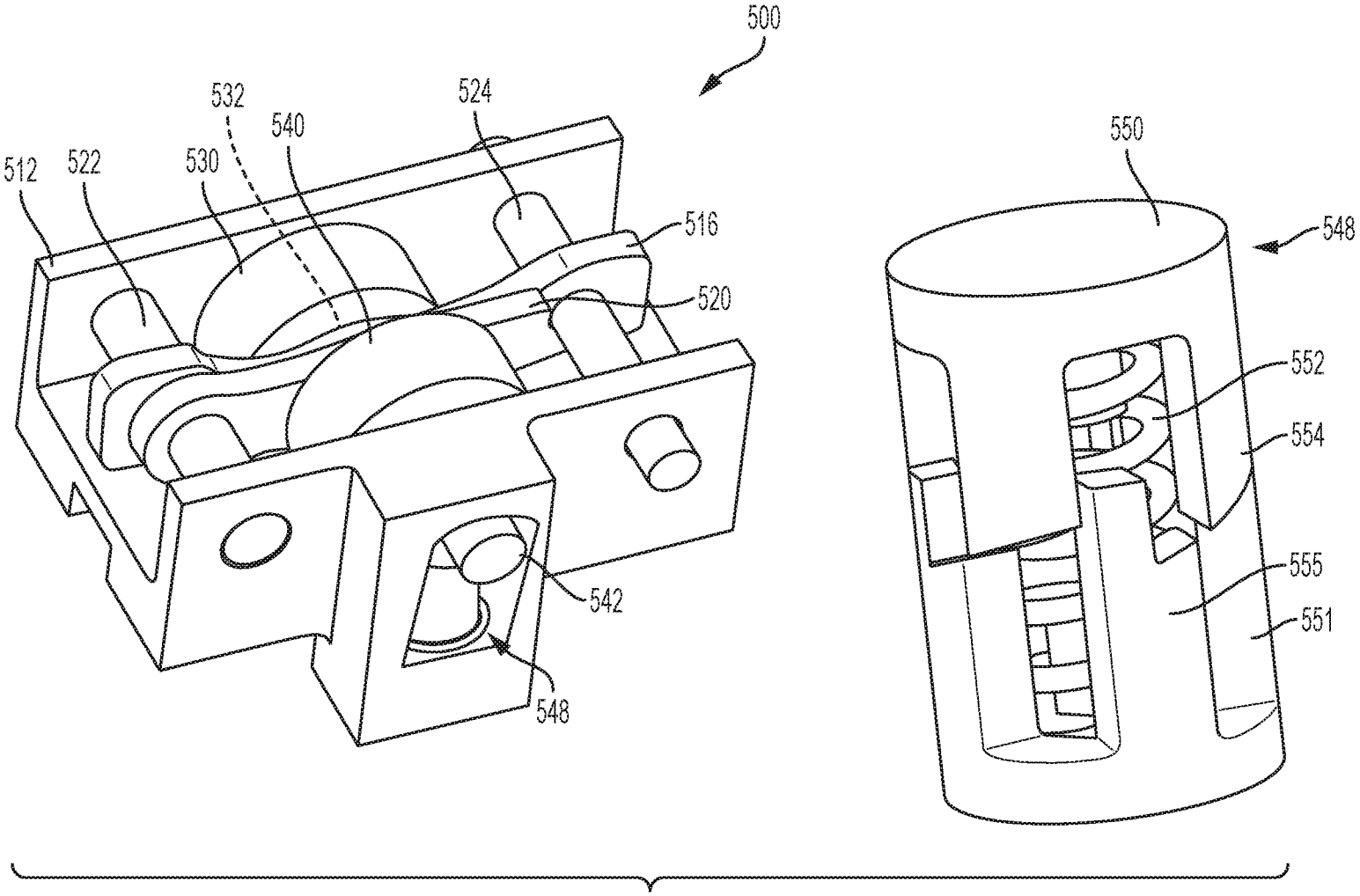
FIG. 22 is a perspective view of a dual roller switching roller finger follower assembly according to yet another example of the present disclosure.
Figure 23B:
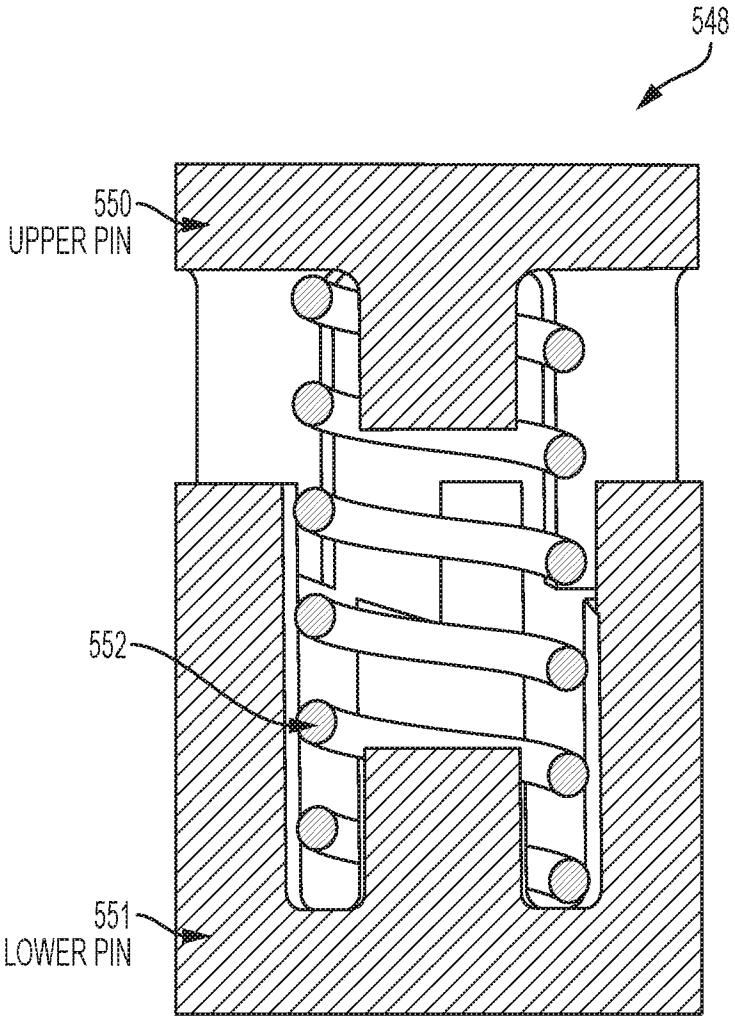
FIG. 23B is a cross-sectional view of the latching mechanism of FIG. 23A in a second position.
Figure 23A:
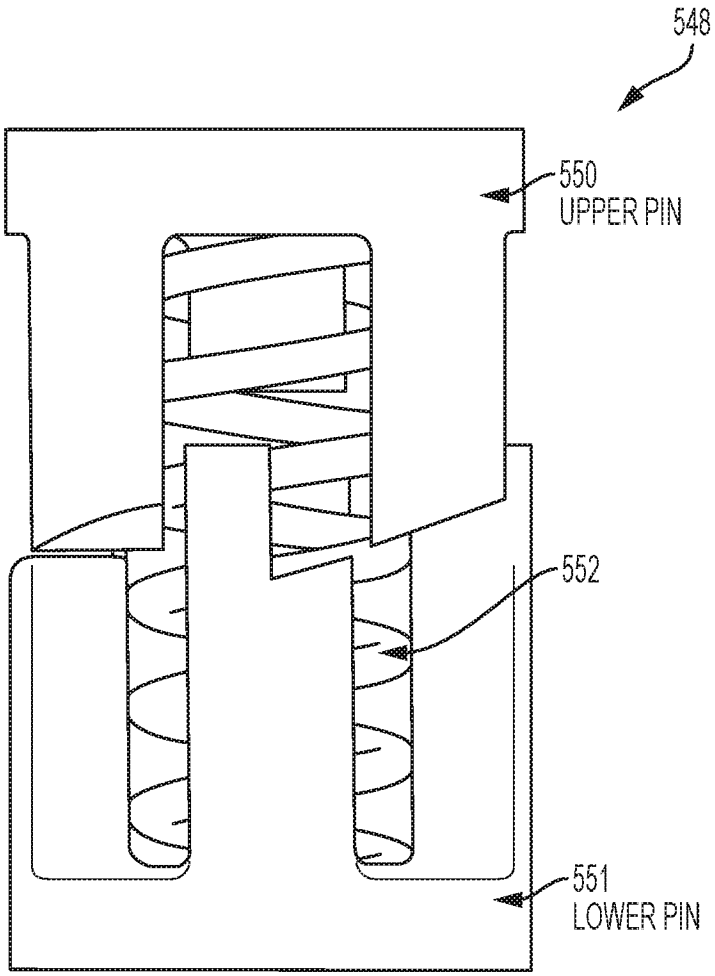
FIG. 23A is a side view of a latching mechanism of the assembly shown in FIG. 22 in a first position, according to the present disclosure.
Figures 24A, 24B, 24C, 24D, 24E:
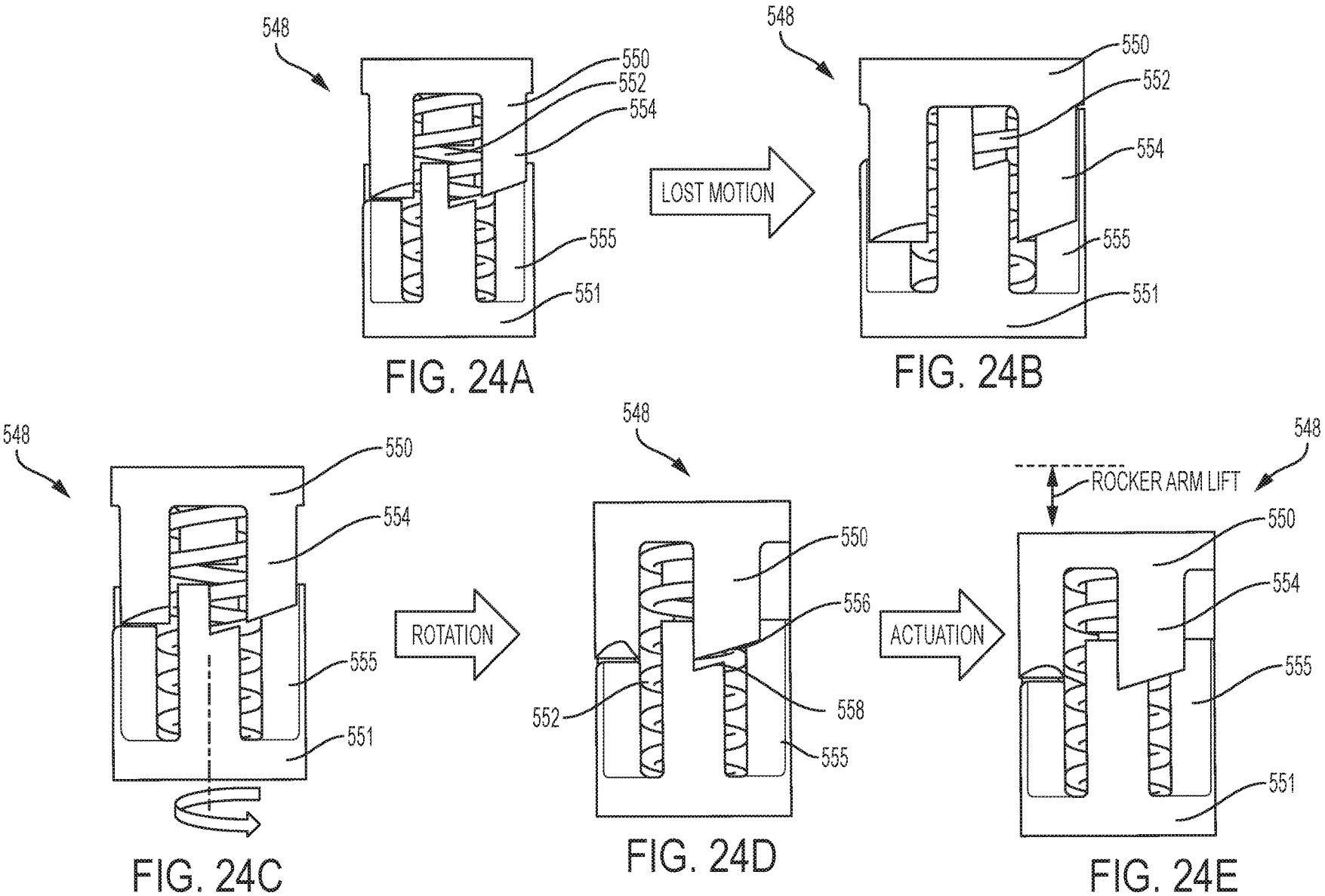
FIG. 24A is a side view of the latching mechanism of FIG. 23A in a third position.
FIG. 24B is a side view of the latching mechanism of FIG. 23A in a fourth position.
FIG. 24C is a side view of the latching mechanism of FIG. 23A in a fifth position.
FIG. 24D is a side view of the latching mechanism of FIG. 23A in a sixth position.
FIG. 24E is a side view of the latching mechanism of FIG. 23A in a seventh position.

With reference to FIGS. 22-24, a dual roller switching roller finger follower assembly 500 will now be described. The dual roller switching roller finger follower assembly 500 includes an outer housing 512, a standard lift arm 516, and a late intake valve closure (LIVC) lift arm 520. The standard lift arm 516 is fixedly mounted to a first pin 522 and a second pin 524. A first roller 530 is rotatably mounted to the standard lift arm 516 on a first axle 532, and a second roller 540 is rotatably mounted to the LIVC lift arm 520 on a second axle 542. As shown in FIG. 22, the first and second axles 532 and 542 are offset, and the LIVC lift arm 520 is permitted to rotate about the first pin 522.

A latching mechanism 548 includes an upper pin 550 and a lower pin 551 that are biased apart by a biasing mechanism (e.g., spring) 552 to move between an extended position and a collapsed position during lost motion. The upper pin 550 has upper fingers 554, and the lower pin 551 has lower fingers 555. During lost motion, the upper fingers 554 and lower fingers 555 are out of alignment (FIG. 24B), allowing the latching mechanism 548 to collapse against the bias of the spring 552. During actuation, (FIGS. 24C-24E), one of the pins, such as the lower pin 551 is rotated (FIGS. 24C-24D) such that the fingers 554 and 555 are aligned for contact. In the example shown, an upper ledge 556 rests on a lower ledge 558 precluding further collapsing.

In the extended position (FIGS. 24D and 24E), the latching mechanism 548 keeps the second roller 540 in an upward position and in contact with a single cam (e.g., similar to cam 358 in FIG. 16). In one example, the standard lift arm 516 and the LIVC lift arm 520 can be formed of stampings. Moreover, the latching mechanism 548 can be actuated hydraulically, electrically, electromagnetically, or by other actuation configurations, such as an electromagnetic solenoid and combinations thereof.

Operation of the dual roller switching roller finger follower assembly 500 will now be described. In normal mode, the standard lift arm 516 is engaged by the cam 558 via roller 530 and rotates to actuate valve 560. During normal mode, the upper pin 550 travels in the empty space in the lower pin 551, resulting in lost motion. Thus, the cam can push the standard arm roller 530 to provide standard lift.

In LIVC mode, the lower pin 551 is rotated, either by hydraulic or electromagnetic means, so that now the upper pin pushes onto the lower pin 551, thus acting as a solid entity. The cam 558 is initially in contact with the standard arm (first) roller 530 up until a point of change 62 (FIG. 18) after which the cam then pushes the LIVC arm (second) roller 540 thus achieving the added LIVC event. The LIVC is achieved as the LIVC arm 520 has a smaller rocker ratio as compared to the standard lift arm 516.

Figure 25:
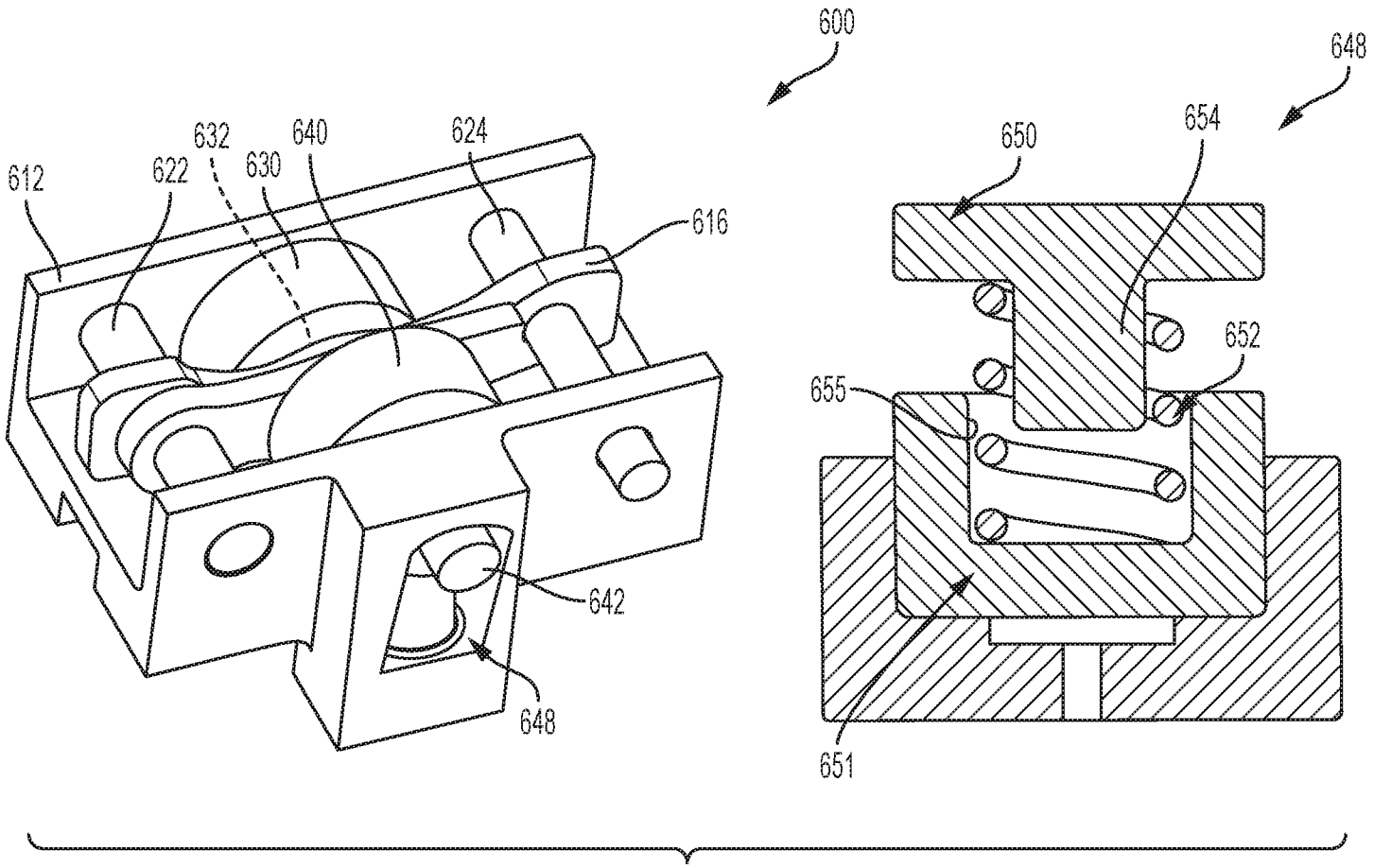
FIG. 25 is a perspective view of a dual roller switching roller finger follower assembly according to yet another example of the present disclosure.

With initial reference to FIGS. 25 and 26, a dual roller switching roller finger follower assembly 600 will now be described. The dual roller switching roller finger follower assembly 600 includes an outer housing 612, a standard lift arm 616, and a late intake valve closure (LIVC) lift arm 620. The standard lift arm 616 is fixedly mounted to a first pin 622 and a second pin 624. A first roller 630 is rotatably mounted to the standard lift arm 616 on a first axle 632, and a second roller 640 is rotatably mounted to the LIVC lift arm 620 on a second axle 642 to the LIVC lift arm 620. In the example shown in FIG. 25, the first and second axles 632 and 642 are offset, and the LIVC lift arm 620 is permitted to rotate about the first pin 622.

Figure 26B:
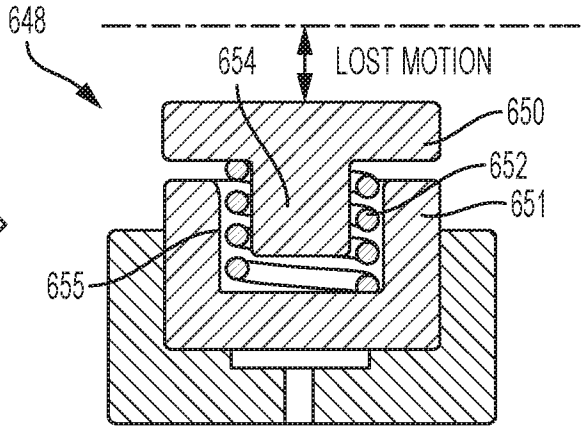
FIG. 26B is a cross-sectional view of the latching mechanism of FIG. 26A in a second position.
Figure 26A:
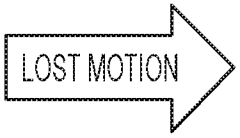
FIG. 26A is a cross-sectional view of a latching mechanism of the assembly shown in FIG. 25 in a first position, according to the present disclosure.
Figure 26A:
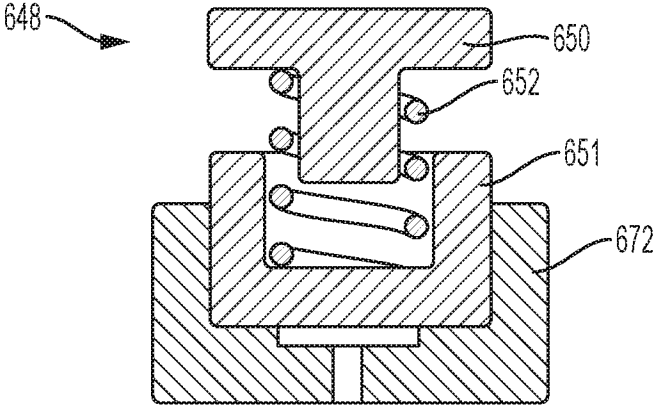

A latching mechanism 648 includes an upper pin 650 and lower pin 651 biased apart by a biasing mechanism (e.g., spring) 652 to move between an extended position and a collapsed position during lost motion. The upper pin 650 has a male extension portion 654, and the lower pin 651 has female receiving portion 655. During lost motion, the male extension portion 654 is received by the female receiving portion 655 (FIG. 26B).

Figure 26E:
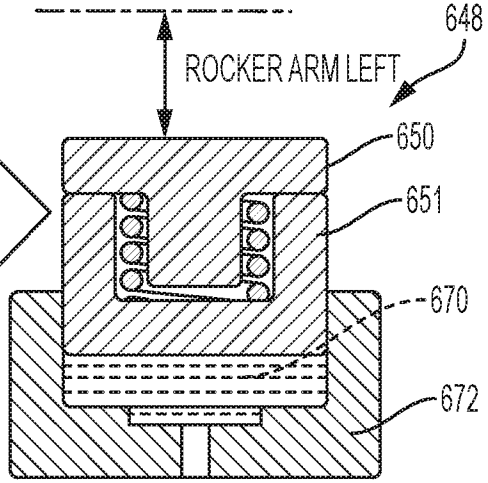
FIG. 26E is a cross-sectional view of the latching mechanism of FIG. 26A in a fifth position.
Figure 26D:
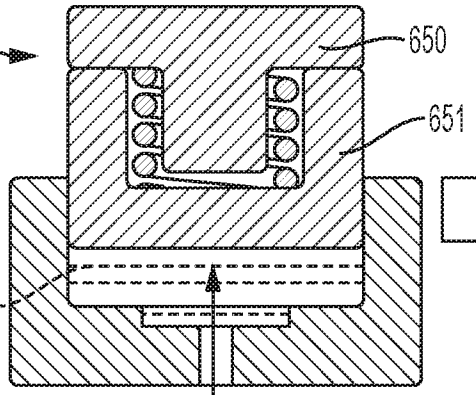
FIG. 26D is a cross-sectional view of the latching mechanism of FIG. 26A in a fourth position.
Figure 26C:
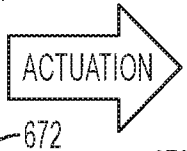
FIG. 26C is a cross-sectional view of the latching mechanism of FIG. 26A in a third position.
Figure 26C:
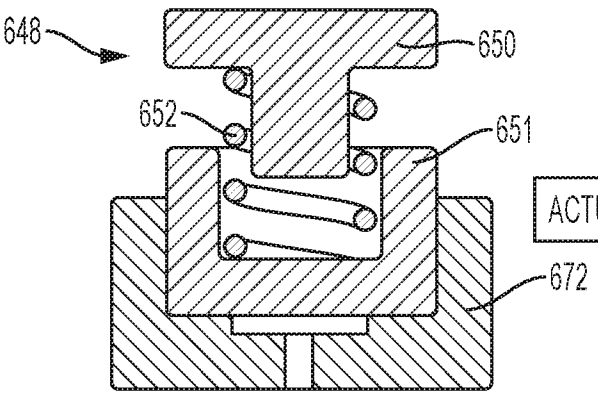

The latching mechanism 648 can be actuated hydraulically using concepts similar to hydraulic lash adjusters. In one configuration, hydraulic fluid can be delivered into a reservoir 670 defined in housing 672 (FIGS. 26D-26E).

Operation of the dual roller switching roller finger follower assembly 600 will now be described. In normal mode, the standard lift arm 616 is engaged by a single cam (e.g., similar to cam 358 in FIG. 16) and rotates to actuate a valve (e.g., valve 36). During normal mode, the male extension portion 654 of the upper pin 650 travels in the female receiving portion 655 in the lower pin 651, resulting in lost motion. Thus, the cam can push the standard arm roller 630 to provide standard lift.

In LIVC mode, the oil pressure forces the lower pin 651 upwards as it compresses the spring 652 such that the entire unit thus acts like a solid member. Initially, the cam is in contact with the standard arm (first) roller 630 up until a point of change 62 (FIG. 18) after which the cam then pushes the LIVC arm (second) roller 640 thus achieving the added LIVC event. The LIVC is achieved as the LIVC arm 620 has a smaller rocker ratio as compared to the standard lift arm 616. According to additional examples of the present disclosure, the HLA can be configured to pump-up and enable LIVC thereby eliminating the need of a latch altogether. The valve would push the oil down in such a configuration.

Moreover, the double roller SRFF may be balanced in various ways. In one example, the double roller SRFF utilizes dual post HLA's. In another example, the moment on the SRFF is offset on the valve side such that it is biased toward normal lift. Such a configuration includes the advantage of lower loads during closing when LIVC becomes active, thereby activating the LIVC profile during deceleration of the valve toward closing, resulting in the lower loads. Further the rocker arm may be balanced in various ways. In one example, such as a double roller rocker arm, the rocker arm is balanced by positioning the HLA pivot (single or dual post), valve centerline and loads imparted from the cam to the rollers. In other configurations, rather than utilizing an HLA post, a pivot post (or shaft) is utilized for back end rotation.

In some embodiments of the dual roller switching roller finger followers described above and shown in FIGS. 15-26, a magnetorheological (MR) fluid may utilized in place of a hydraulic fluids such that a locking pin or latching mechanism may be locked in place using MR resistance or enable it to operate in lost motion when the MR fluid is in the free state. In operation, the MR fluid exhibits low viscosity when not in the presence of a magnetic field. However, ferromagnetic particles within the MR fluid align in the presence of a magnetic field, thereby increasing the viscosity of the MR fluid.

Accordingly, as shown with further reference to FIGS. 27-34, the valve timing of the above systems (e.g., 300, 400, 500, 600) may controlled by varying the diameter of the roller (e.g., 330 or 340) as well as the rocker ratio. In this way, an angle '$\alpha$' is a parameter which varies as the rocker ratio and the roller diameter are varied. Accordingly, control of angle '$\alpha$' subsequently controls the change in valve timing, as illustrated herein in more detail. Moreover, as shown by FIGS. 27-34, moving the roller closer to the valve and/or varying the diameter of the roller affects the rocker ratio. In a single lobe cam configuration, as the two rollers are moved together, the interface point of the cam to the roller is changed, which results in different valve lift profiles (e.g., as illustrated in FIGS. Changing the rocker ratio of two rollers in the same arm. You want LIVC roller to be closer to the valve and the element of where you catch that added motion is dependent on how far out that roller is and the diameter.

Figure 27:
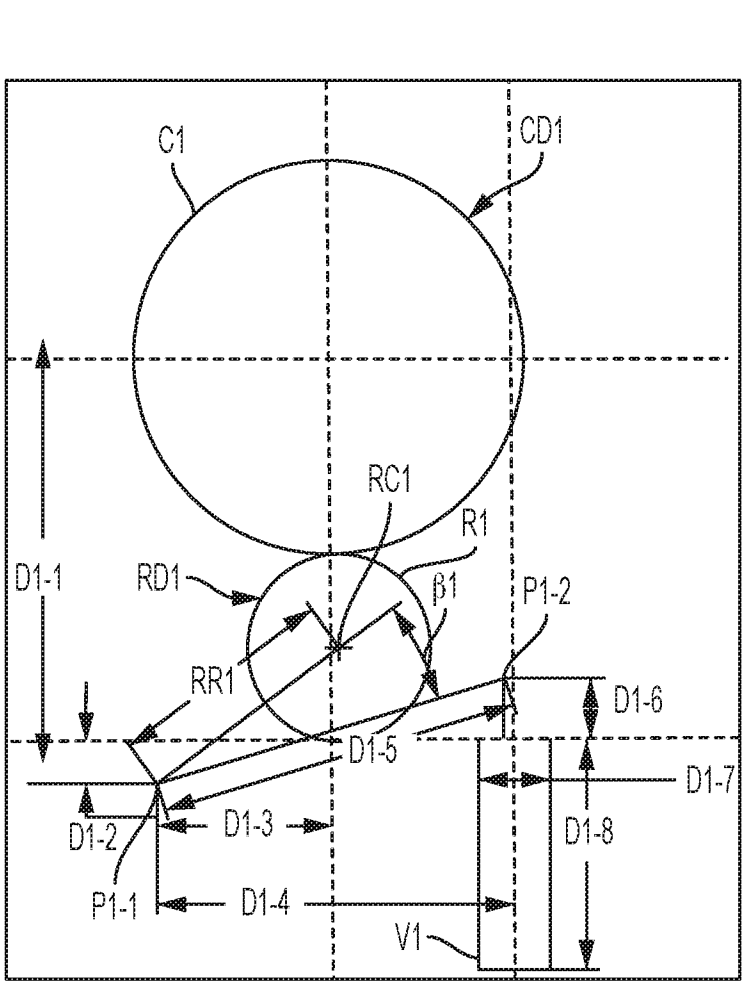
FIG. 27 is a schematic illustration of an example roller finger follower assembly configured for a standard lift mode according to the present disclosure.

FIG. 27 illustrates a baseline illustrative of one example standard lift configuration 800 that includes a cam C1 having a cam diameter CD1, a roller having a roller center point RC1, and a valve V1. Configuration 800 includes a point P1-1, and a point P1-2. A rocker ratio RR1 is defined by the distance between point P1-1 and roller center RC1.

Configuration 800 is further defined by distance D1-1, distance D1-2, distance D1-3, distance D1-4, distance D1-5, distance D1-6, distance D1-7, and distance D1-8. In one example, roller diameter RD1 is 8 mm or approximately 8 mm, and roller ratio RR1 is 19.85 mm or approximately 19.85 mm. A roller angle $\beta$1 is defined between a line extending between point P1-1 and roller center RC1, and a line between point P1-1 and point P2-2. In one example, angle $\beta$1 is between 19° and 20° or between approximately 19° and approximately 20°. In another example, angle $\beta$1 is 19.37° or approximately 19.37°.

Figure 28:
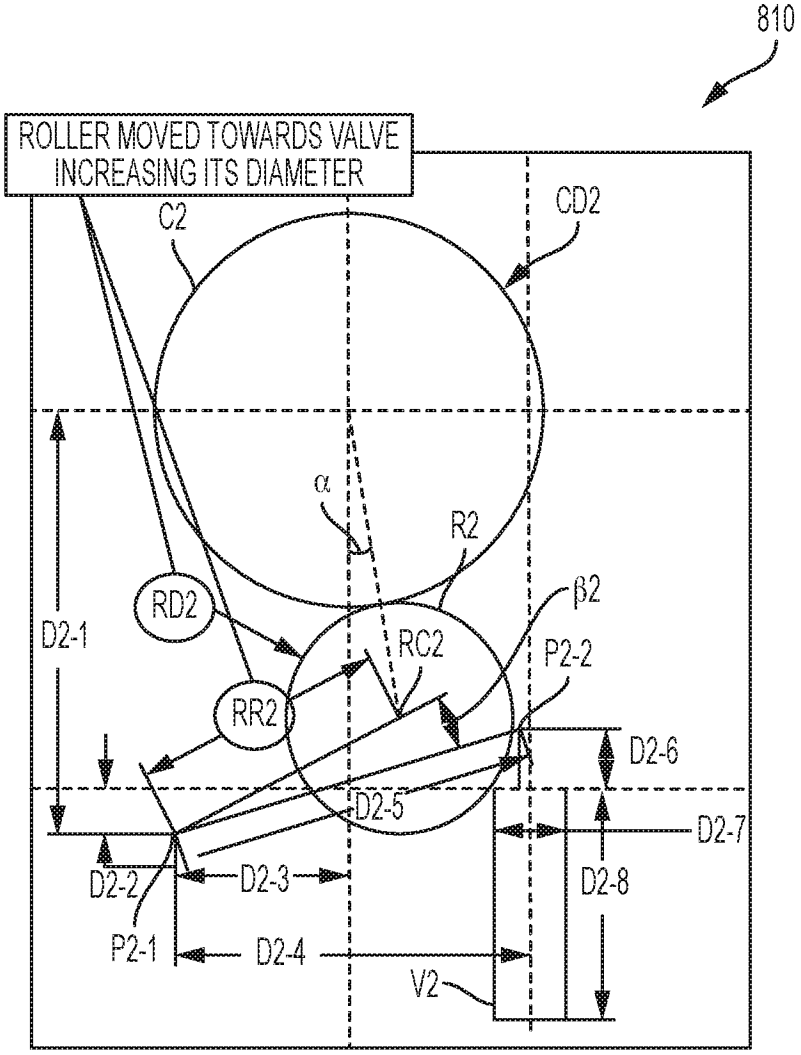
FIG. 28 is a schematic illustration of an example switching roller finger follower assembly configured for a LIVC mode according to the present disclosure.

FIG. 28 illustrates one example LIVC lift configuration 810 that includes a cam C2 having a cam diameter CD2, a roller having a roller center point RC2, and a valve V2. Configuration 810 includes a point P2-1, a point P2-2, and a rocker ratio RR2 defined by the distance between point P2-1 and roller center RC2. Configuration 810 is further defined by distances D2-1, D2-2, D2-3, D2-4, D2-5, D2-6, D2-7, and D2-8. In one example, roller diameter RD2 is 10 mm or approximately 10 mm, and roller ratio RR2 is 22 mm or approximately 22 mm. A roller angle $\beta$2 is defined between a line extending between point P2-1 and roller center RC2, and a line between point P2-1 and point P2-2. In one example, angle $\beta$2 is between 10° and 11° or between approximately 10° and approximately 11°. In other examples, angle $\beta$2 is 10.4° or approximately 10.4°.

Figure 29:
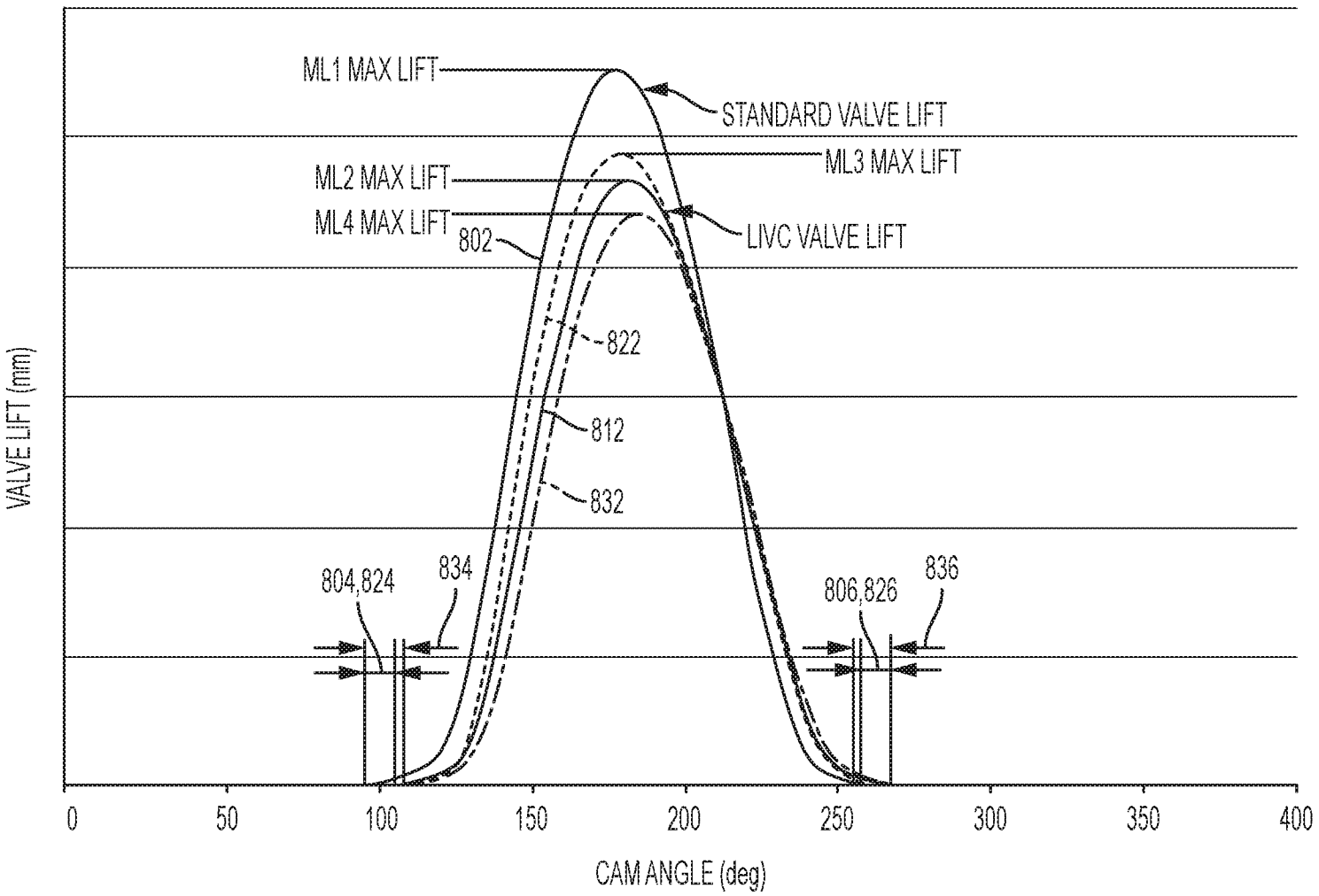
FIG. 29 is a plot illustrating the standard valve lift of the assembly of FIG. 27 and the LIVC valve lift of the assemblies of FIGS. 28, 30, and 31 according to the present disclosure.

As illustrated, LIVC lift configuration 810 is similar to standard lift configuration 800 except roller R2 is increased in diameter and moved closer toward valve V2. The difference in valve lift operation between configurations 800 and 810 is illustrated in FIG. 29 where the valve lift (in mm) is shown the angle of cam C1, C2 (in degrees). The valve lift of standard lift configuration 800 is represented by line 802 and the valve lift of LIVC lift configuration 810 is represented by line 812.

As such, configuration 800 produces a maximum lift ML1, and configuration 810 produces a maximum lift ML2. In one example, ML1 is 11 mm or approximately 11 mm, and ML2 is 9.3 mm or approximately 9.3 mm. Further, the LIVC lift configuration 810 opens at a later cam angle relative to the standard valve lift configuration 800, as shown by distance 804. Similarly, the LIVC lift configuration 810 closes at a later cam angle relative to the standard valve lift configuration 800, as shown by distance 806. In one example, distance 804 is 7.5 degrees or approximately 7.5 degrees, and distance 806 is 7.5 degrees or approximately 7.5 degrees.

Figure 30:
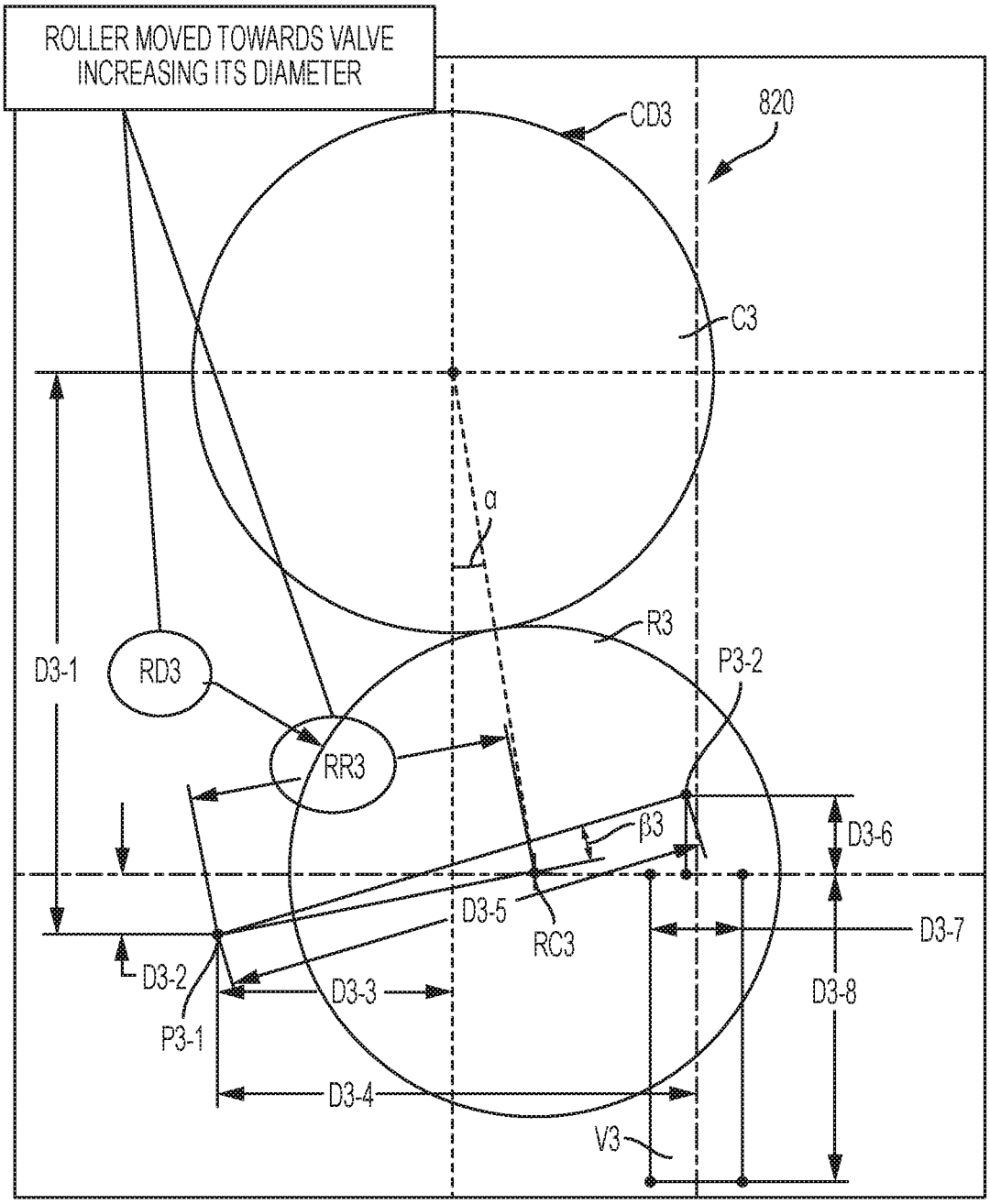
FIG. 30 is a schematic illustration of another example switching roller finger follower assembly configured for a LIVC mode according to the present disclosure.

FIG. 30 illustrates another example LIVC lift configuration 820 that includes a cam C3 having a cam diameter CD3, a roller having a roller center point RC3, and a valve V3. Configuration 820 includes a point P3-1, a point P3-2, and a rocker ratio RR3 defined by the distance between point P3-1 and roller center RC3. Configuration 820 is further defined by distances D3-1, D3-2, D3-3, D3-4, D3-5, D3-6, D3-7, and D3-8. In one example, roller diameter RD3 is 16 mm or approximately 16 mm, and roller ratio RR2 is 21 mm or approximately 21 mm. A roller angle $\beta$3 is defined between a line extending between point P3-1 and roller center RC3, and a line between point P3-1 and point P3-2. In one example, angle $\beta$3 is between 5° and 6° or between approximately 5° and approximately 6°. In other examples, angle $\beta$3 is 5.42° or approximately 5.42°.

As illustrated, LIVC lift configuration 820 is similar to standard lift configuration 800 except roller R3 is increased in diameter and moved closer toward valve V3. The difference in valve lift operation between configurations 800 and 820 is illustrated in FIG. 29 where the valve lift (in mm) is shown the angle of cam C1, C3 (in degrees). The valve lift of standard lift configuration 800 is represented by line 802 and the valve lift of LIVC lift configuration 820 is represented by line 822.

As such, configuration 800 produces a maximum lift ML1, and configuration 820 produces a maximum lift ML3. In one example, ML1 is 11 mm or approximately 11 mm, and ML3 is 9.71 mm or approximately 9.71 mm. Further, the LIVC lift configuration 820 opens at a later cam angle relative to the standard valve lift configuration 800, as shown by distance 824. Similarly, the LIVC lift configuration 820 closes at a later cam angle relative to the standard valve lift configuration 800, as shown by distance 826. In one example, distance 824 is 7.5 degrees or approximately 7.5 degrees, and distance 826 is 7.5 degrees or approximately 7.5 degrees.

Figure 31:
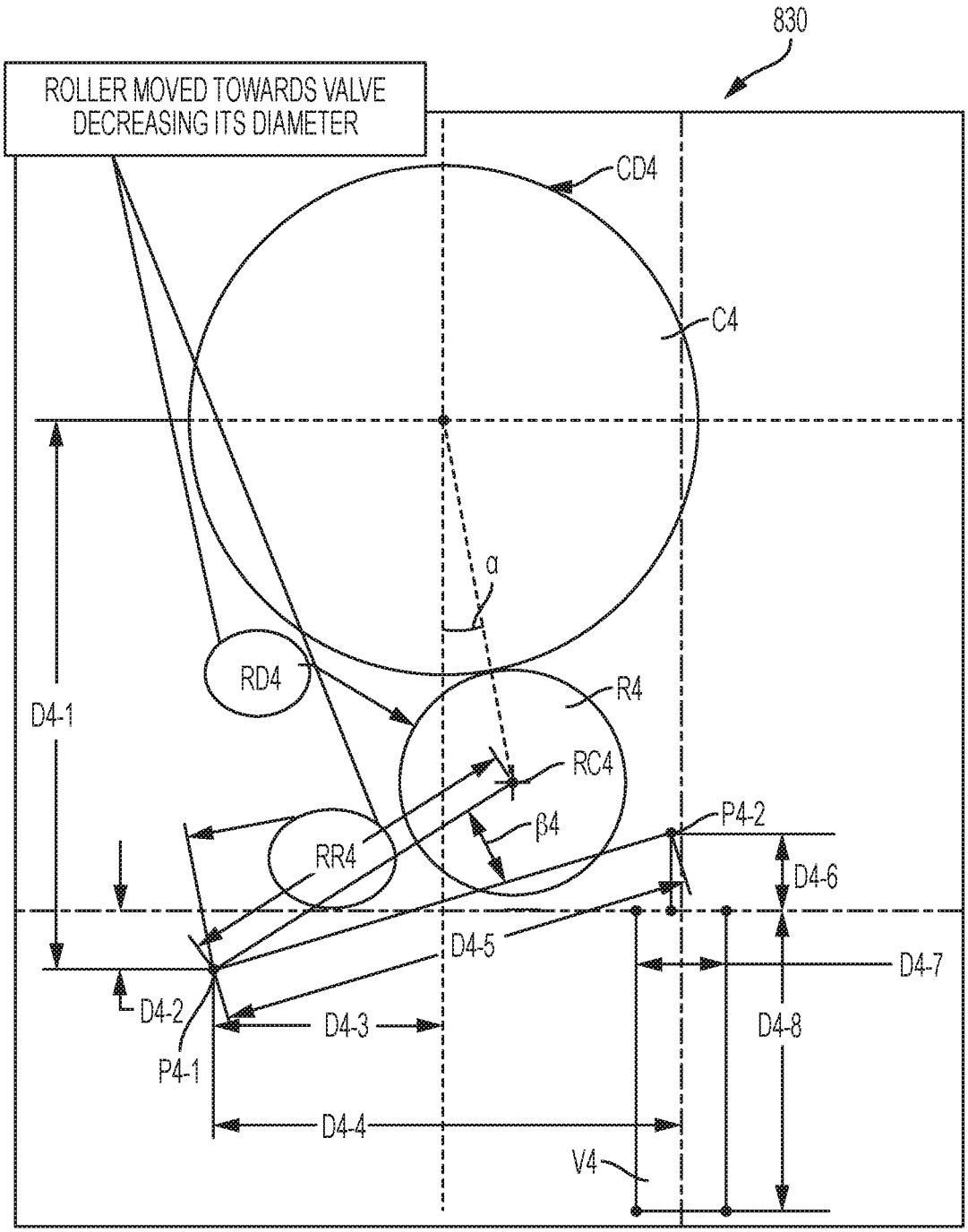
FIG. 31 is a schematic illustration of yet another example switching roller finger follower assembly configured for a LIVC mode according to the present disclosure.

FIG. 31 illustrates another example LIVC lift configuration 830 that includes a cam C4 having a cam diameter CD4, a roller having a roller center point RC4, and a valve V4. Configuration 830 includes a point P4-1, a point P4-2, and a rocker ratio RR4 defined by the distance between point P4-1 and roller center RC4. Configuration 830 is further defined by distances D4-1, D4-2, D4-3, D4-4, D4-5, D4-6, D4-7, and D4-8. In one example, roller diameter RD4 is 7.5 mm or approximately 7.5 mm, and roller ratio RR4 is 23.5 mm or approximately 23.5 mm. A roller angle (34 is defined between a line extending between point P4-1 and roller center RC4, and a line between point P4-1 and point P4-2. In one example, angle β4 is between 15° and 16° or between approximately 15° and approximately 16°. In other examples, angle β4 is 15.73° or approximately 15.73°.

As illustrated, LIVC lift configuration 830 is similar to standard lift configuration 800 except roller R4 is decreased in diameter and moved closer toward valve V4. The difference in valve lift operation between configurations 800 and 830 is illustrated in FIG. 29 where the valve lift (in mm) is shown the angle of cam C1, C4 (in degrees). The valve lift of standard lift configuration 800 is represented by line 802 and the valve lift of LIVC lift configuration 830 is represented by line 832.

As such, configuration 800 produces a maximum lift ML1, and configuration 830 produces a maximum lift ML4. In one example, ML1 is 11 mm or approximately 11 mm, and ML4 is 8.8 mm or approximately 8.8 mm. Further, the LIVC lift configuration 830 opens at a later cam angle relative to the standard valve lift configuration 800, as shown by distance 834. Similarly, the LIVC lift configuration 830 closes at a later cam angle relative to the standard valve lift configuration 800, as shown by distance 836. In one example, distance 834 is 8.5 degrees or approximately 8.5 degrees, and distance 836 is 8.5 degrees or approximately 8.5 degrees.

Figure 32:
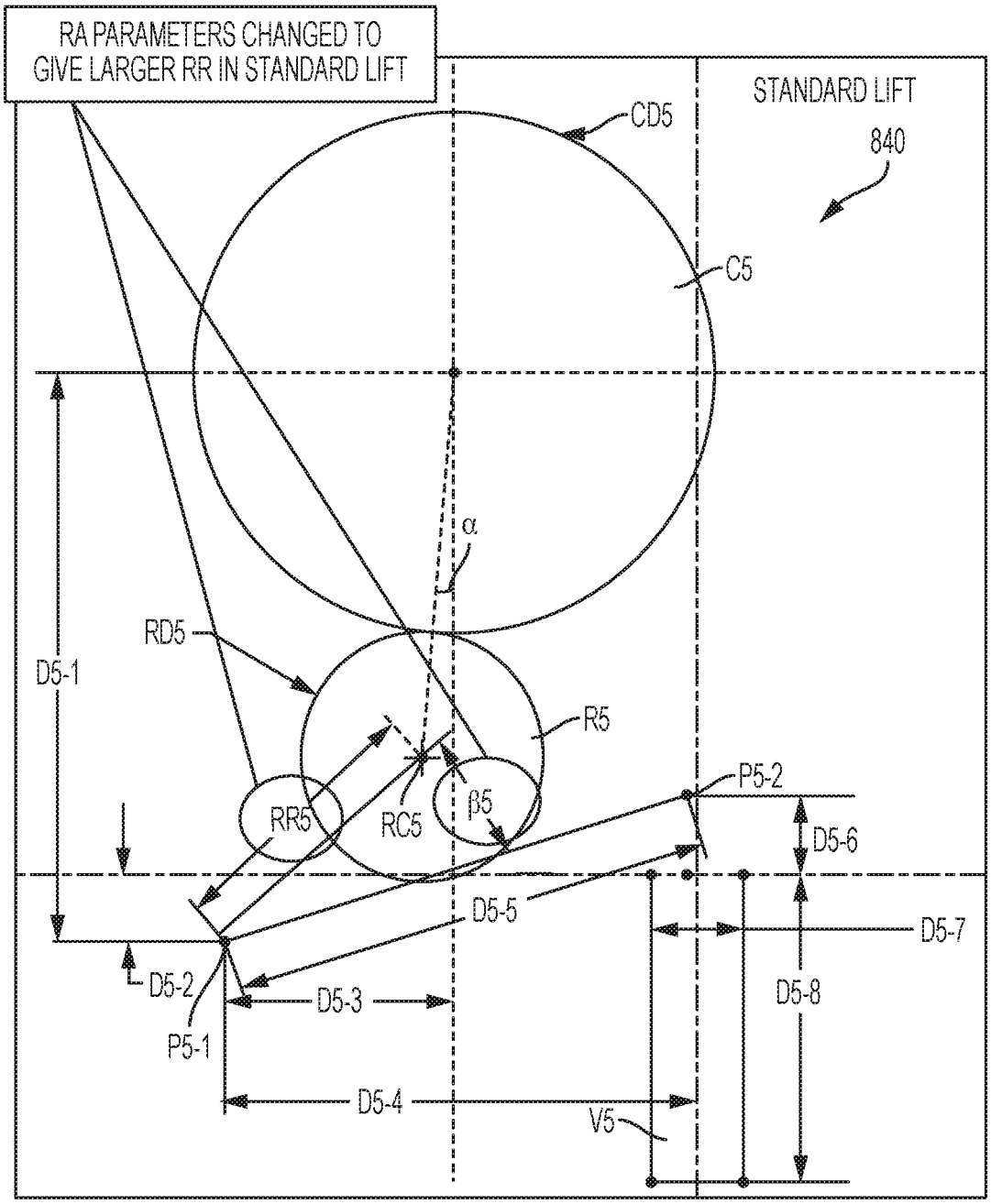
FIG. 32 is a schematic illustration of another example roller finger follower assembly configured for a standard lift mode according to the present disclosure.

FIG. 32 illustrates a baseline illustrative of another example standard lift configuration 840 that includes a cam C5 having a cam diameter CD5, a roller having a roller center point RC5, and a valve V5. Configuration 840 includes a point P5-1, a point P5-2, and a rocker ratio RR5 defined by the distance between point P5-1 and roller center RC5. Configuration 840 is further defined by distances D5-1, D5-2, D5-3, D5-4, D5-5, D5-6, D5-7, and D5-8. In one example, roller diameter RD5 is 8 mm or approximately 8 mm, and roller ratio RR5 is 17.5 mm or approximately 17.5 mm. A roller angle β5 is defined between a line extending between point P5-1 and roller center RC5, and a line between point P5-1 and point P5-2. In one example, angle β5 is between 25° and 26° or between approximately 25° and approximately 26°. In other examples, angle β5 is 25.63° or approximately 25.63°.

Figure 33:
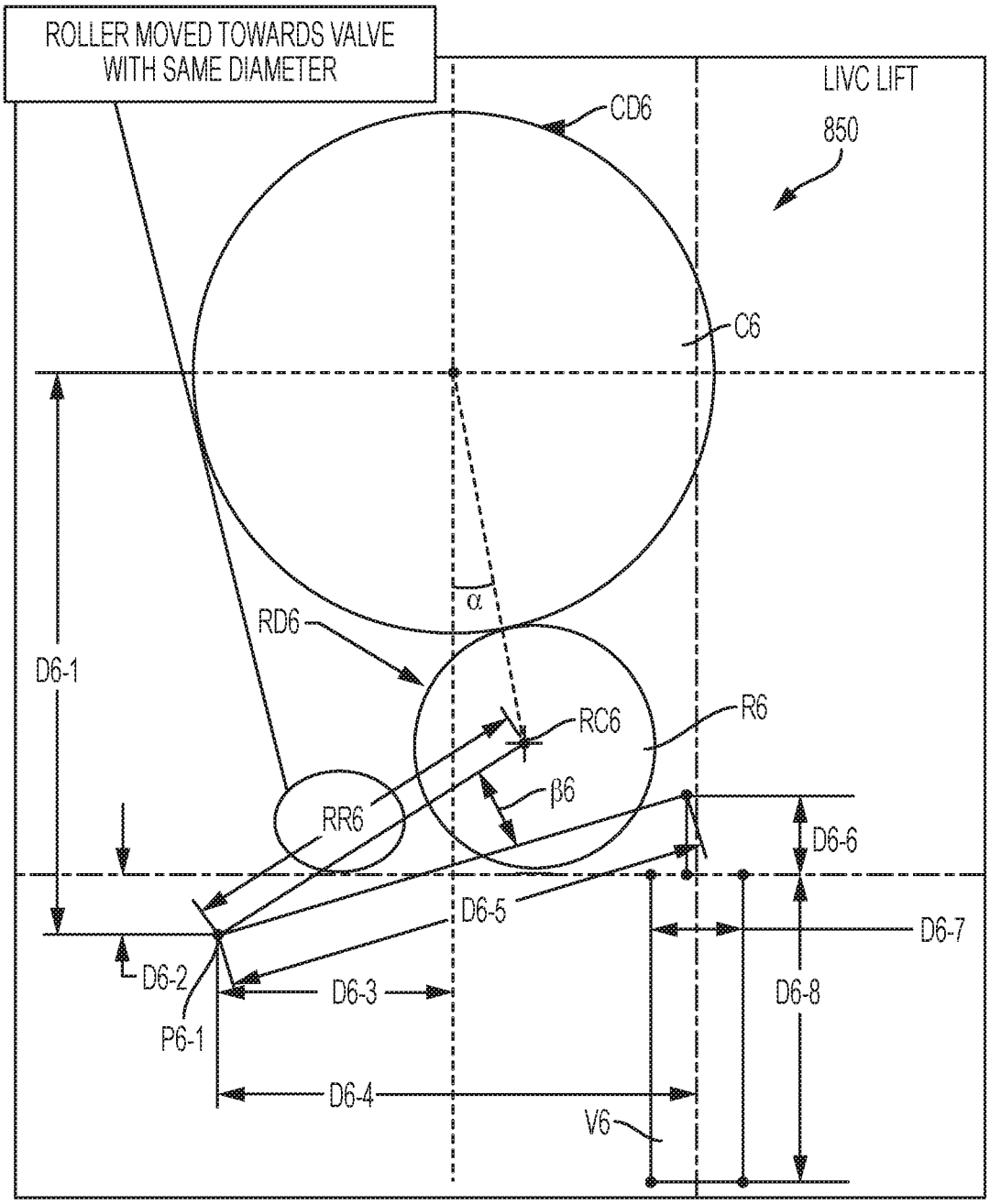
FIG. 33 is a schematic illustration of yet another example switching roller finger follower assembly configured for a LIVC mode according to the present disclosure.

FIG. 33 illustrates another example LIVC lift configuration 850 that includes a cam C6 having a cam diameter CD6, a roller having a roller center point RC6, and a valve V6. Configuration 850 includes a point P6-1, a point P6-2, and a rocker ratio RR6 defined by the distance between point P6-1 and roller center RC6. Configuration 850 is further defined by distances D6-1, D6-2, D6-3, D6-4, D6-5, D6-6, D6-7, and D6-8. In one example, roller diameter RD6 is 8 mm or approximately 8 mm, and roller ratio RR6 is 23.5 mm or approximately 23.5 mm. A roller angle β6 is defined between a line extending between point P6-1 and roller center RC6, and a line between point P6-1 and point P6-2. In one example, angle β6 is between 14° and 15° or between approximately 14° and approximately 15°. In other examples, angle β6 is 14.43° or approximately 14.43°.

Figure 34:
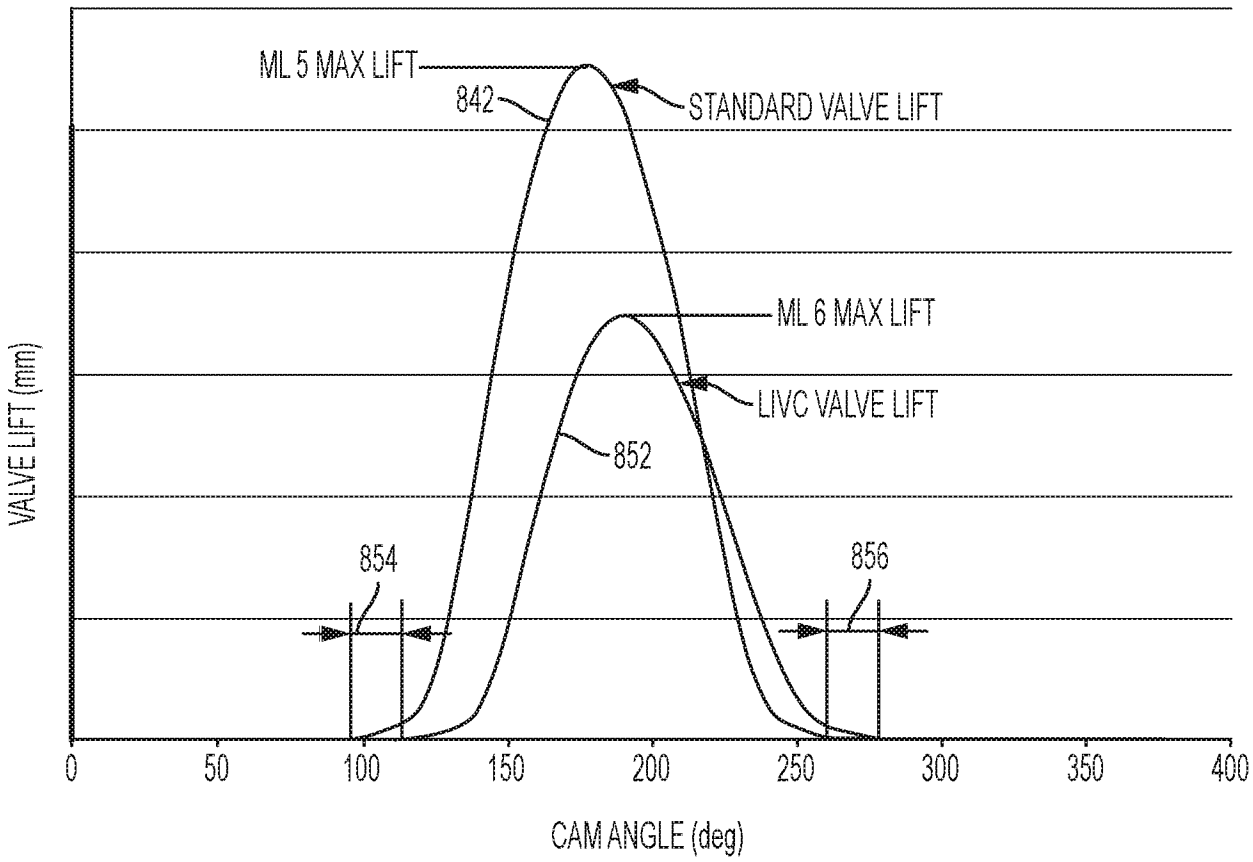
FIG. 34 is a plot illustrating the standard valve lift of the assembly of FIG. 32 and the LIVC valve lift of the assembly of FIG. 33 according to the present disclosure.

As illustrated, LIVC lift configuration 850 is similar to standard lift configuration 840 except roller R6 is moved closer toward valve V6. The difference in valve lift operation between configurations 840 and 850 is illustrated in FIG. 34 where the valve lift (in mm) is shown the angle of cam C5, C6 (in degrees). The valve lift of standard lift configuration 840 is represented by line 842 and the valve lift of LIVC lift configuration 850 is represented by line 852.

As such, configuration 840 produces a maximum lift ML5, and configuration 850 produces a maximum lift ML6. In one example, ML5 is 11 mm or approximately 11 mm, and ML6 is 6.89 mm or approximately 6.89 mm. Further, the LIVC lift configuration 850 opens at a later cam angle relative to the standard valve lift configuration 840, as shown by distance 854. Similarly, the LIVC lift configuration 850 closes at a later cam angle relative to the standard valve lift configuration 840, as shown by distance 856. In one example, distance 854 is 16.5 degrees or approximately 16.5 degrees, and distance 856 is 16.5 degrees or approximately 16.5 degrees.

In still other configurations (not shown), roller diameter RD5 is 8 mm or approximately 8 mm, roller ratio RR5 is 17 mm or approximately 17 mm, and roller angle β5 is between 27° and 28° or between approximately 27° and approximately 28°. In other examples, angle β5 is 27.58° or approximately 27.58°. In still other configurations, roller diameter RD6 is 8 mm or approximately 8 mm, roller ratio RR6 is 24 mm or approximately 24 mm, and roller angle β6 is between 14° and 15° or between approximately 13° and approximately 15°. In other examples, angle β6 is 14.01° or approximately 14.01°. In such examples, LIVC lift configuration 850 is similar to standard lift configuration 840 except roller R6 is moved closer toward valve V6. The difference in valve lift operation between configurations 840 and 850 results in configuration 840 producing a maximum lift of 11 mm or approximately 11 mm, and configuration 850 producing a maximum lift 6.24 mm or approximately 6.24 mm, with a transition (overlap of valve lift) at 4.49 mm or approximately 4.49 mm. Further, the LIVC lift configuration 850 opens at a later cam angle relative to the standard valve lift configuration 840 of 19.5° or approximately 19.5°, and configuration 850 closes at a later cam angle relative to configuration 840 of 19.5° or approximately 19.5°.

In still other configurations (not shown), roller diameter RD5 is 8 mm or approximately 8 mm, roller ratio RR5 is 16.5 mm or approximately 16.5 mm, and roller angle β5 is between 29° and 31° or between approximately 29° and approximately 31°. In other examples, angle β5 is 29.89° or approximately 29.89°. In still other configurations, roller diameter RD6 is 8 mm or approximately 8 mm, roller ratio RR6 is 26 mm or approximately 26 mm, and roller angle β6 is between 12° and 14° or between approximately 12° and approximately 14°. In other examples, angle β6 is 12.75° or approximately 12.75°. In such examples, LIVC lift configuration 850 is similar to standard lift configuration 840 except roller R6 is moved closer toward valve V6. The difference in valve lift operation between configurations 840 and 850 results in configuration 840 producing a maximum lift of 11 mm or approximately 11 mm, and configuration 850 producing a maximum lift 5.19 mm or approximately 5.19 mm, with a transition (overlap of valve lift) at 4.09 mm or approximately 4.49 mm. Further, the LIVC lift configuration 850 opens at a later cam angle relative to the standard valve lift configuration 840 of 26.2° or approximately 26.2°, and configuration 850 closes at a later cam angle relative to configuration 840 of 26.2° or approximately 26.2°.

Valve train systems and arrangements can have various components and configurations such as that described in commonly owned PCT Application PCT/US2016/068118, filed Dec. 21, 2016, the contents of which are incorporated herein in their entirety by reference thereto.

Figure 1:
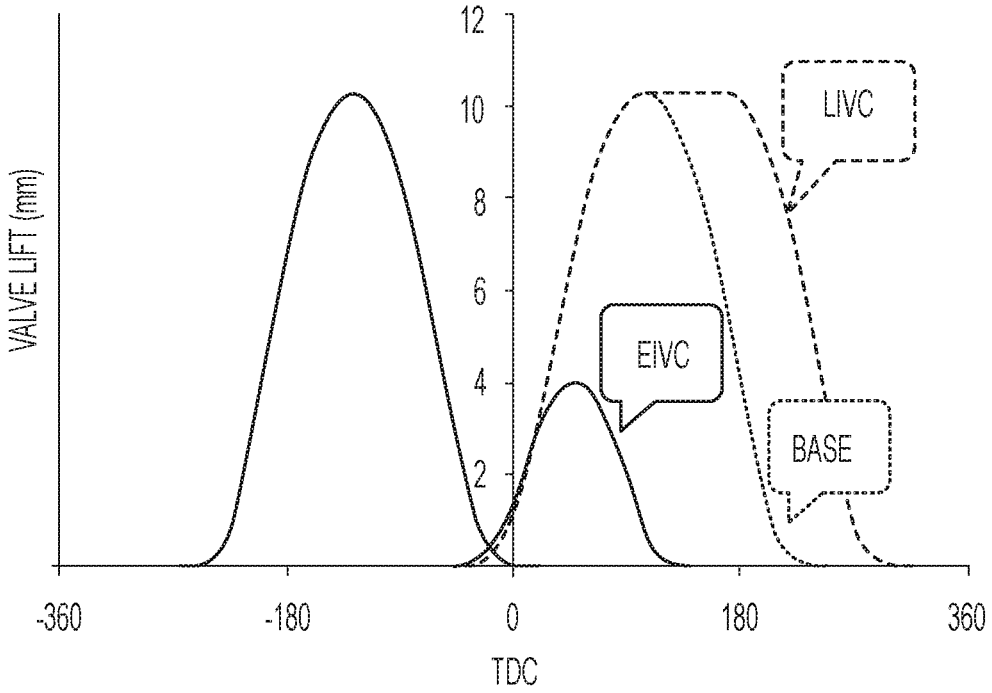
FIG. 1 PRIOR ART
FIG. 1 is plot illustrating discrete variable valve lift and cycles according to Prior Art.
Figure 2:
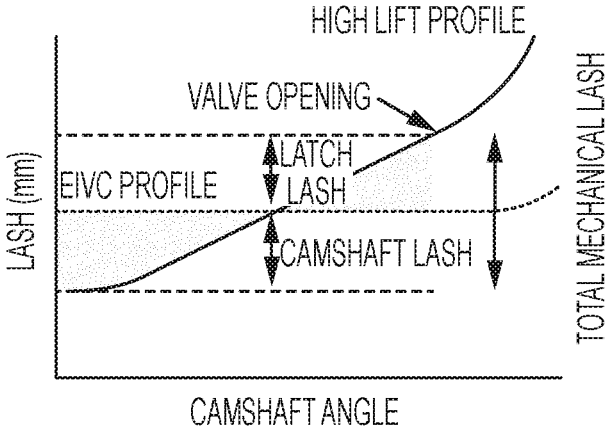
FIG. 2 PRIOR ART
FIG. 2 is a graphic illustrating lash on a switching roller finger follower according to Prior Art.

With initial reference to FIGS. 1-3, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking.

The partial valve train assembly 10 can include a valvetrain carrier 12 and a rocker assembly housing 14 that supports a rocker arm assembly 20 having a series of intake valve rocker arm assemblies 28 (only one shown) and a series of exhaust valve rocker arm assemblies (not shown). A rocker shaft 30 is received by a rocker housing 32. As will be described in detail herein, the rocker shaft 30 cooperates with the rocker arm assembly 20 and more specifically to the intake valve rocker arm assemblies to communicate oil to the intake valve rocker arm assemblies 28 during early intake valve closing (EIVC) operations.

With further reference now to FIGS. 2 and 3, the intake valve rocker arm assembly 28 will be further described. In the example embodiment, the intake valve rocker arm assembly 28 includes a rocker arm 36 having an e-foot 38 that is engaged by a pushrod 54 via a wedge mechanism or variable lift mechanism 56. The pushrod 54 moves upward and downward based on a lift profile of a cam shaft (not shown). Upward movement of the pushrod 54 pushes the rocker arm 36 and in turn causes the rocker arm 36 to rotate around the rocker shaft 30.

With continued reference to FIG. 1, the valvetrain carrier 12 generally includes a carrier body 60 defining a first bore 62 and a second bore 64. The first bore 62 receives the variable lift mechanism 56, and the second bore 64 receives a spool valve 68. A check valve 70 (e.g., ball and spring) is disposed in a cavity 72 that is fluidly connected to first bore 62 via a port 74. An accumulator 76 is operably associated with spool valve 68 and is connected thereto via a port 78. The second bore 64 is fluidly connected to the first bore 62 via a discharge orifice or port 80.

With additional reference to FIGS. 5 and 6, the variable lift mechanism 56 will be described in more detail. In the example embodiment, the variable lift mechanism 56 generally includes an upper capsule or cylinder 82 and a lower capsule or cylinder 84 that are biased apart by a biasing mechanism (e.g., spring) 86. The variable lift mechanism 56 is configured to move between a collapsed position (left, FIG. 5), a rotated, increased lift position (right, FIG. 5), and an extended position (FIG. 1). In this way, variable valve lift mechanism 56 is configured to provide at least three different lift profiles based on operation in the described positions, as described herein in more detail.

With continued reference to FIG. 5, the upper cylinder 82 has an upper wedge 88, and the lower cylinder 84 has a lower wedge 90. In the collapsed position, the upper wedge 88 and the lower wedge 90 are out of alignment, allowing the variable lift mechanism to collapse against the bias of spring 86. During actuation, one of the cylinders 82, 84, such as upper cylinder 82, is rotated such that upper wedge 88 and lower wedge 90 are aligned for contact. As shown in the rightmost illustration in FIG. 5, upper wedge 88 rests on lower wedge 90, which subsequently gives variable lift mechanism 56 an increased height 'Δt' to produce increased valve lift and, in the example embodiment, a comparatively late early closing of the intake valve (EIVC).

As shown in FIG. 5, in the example embodiment, upper wedge 88 is disposed at an angle 'α' and lower wedge 90 is disposed at an angle 'β' (relative to a horizontal 95). Varying angle 'α' and/or 'β' enables varying of 'Δt' to produce a desired lift. In one example, angle 'α' is between approximately 0° and approximately 45° or between 0° and 45°. In another example, angle 'β' is between approximately 0° and approximately 45° or between 0° and 45°. In the illustrated example, angles 'α' and 'β' are equal or substantially equal. However, it will be appreciated that angles 'α' and 'β' may be different.

One example operation of the valvetrain carrier 12 will now be described. In normal mode, the spool valve 68 is closed and fluid within the variable lift mechanism 56 will act as a rigid body and the valve lift we be normal as designed. When the spool valve 68 opens, the fluid in variable lift mechanism 56 is drained and the cylinders 82, 84 are arranged as shown in FIG. 5, left. In this position, the system produces an EIVC.

With spool valve 68 open, one of the cylinders 82, 84 can then be rotated to be arranged as shown in FIG. 5, right. For example, one of cylinders 82, 84 can include a knob 92 that can be engaged to rotate cylinders 82, 84. For example, knob 92 may be engaged mechanically, hydraulically, magnetically, electrically, etc. In this rotated position, there is a different height of variable lift mechanism 56 to produce a different lift than in the extended and collapsed positions. It will be appreciated that additional wedges may be provided cylinder 82 and/or cylinder 84 to provide additional different lifts.

In some examples, more than three different timings or EIVC is accomplished by providing intermittent positions for knob 92 while it rotates from zero degrees to a predetermined maximum value. Accordingly, EIVC can be varied between a range of values depending on desired design.

Accordingly, the systems and methods described herein enable at least three different timings of early closing of the intake valve (early intake valve closing). This is achieved by varying the pushrod length by draining the column of liquid present in the two cylinders of a variable lift mechanism. When the spool valve is closed, the incompressible fluid acts as a rigid body. When the spool valve opens and drains the fluid out, the length of the pushrod changes leading to an early closing of the intake valve.

Additionally, at the interface of the two cylinders, a cam-like wedge fitting is provided. A knob can be fitted onto the upper or lower cylinders as desired. The variable lift mechanism can have three orientations. (1) When the spool valve is closed, the fluid will act as a rigid body and the valve lift will be normal. (2) When the spool valve opens and the capsules are arranged as in FIG. 5, left, the variable lift mechanism produces an early closing of the intake valve. (3) When the spool valve opens and the cylinders are rotated and arranged as in FIG. 5, right, the variable lift mechanism produces a different (comparatively late) early closing of the intake valve. In some examples, the valvetrain carrier 10 can be alternatively configured for LIVC.

Valve train systems and arrangements can have various components and configurations such as that described in commonly owned PCT Application PCT/US2016/068118, filed Dec. 21, 2016, the contents of which are incorporated herein in their entirety by reference thereto.

Figure 35:
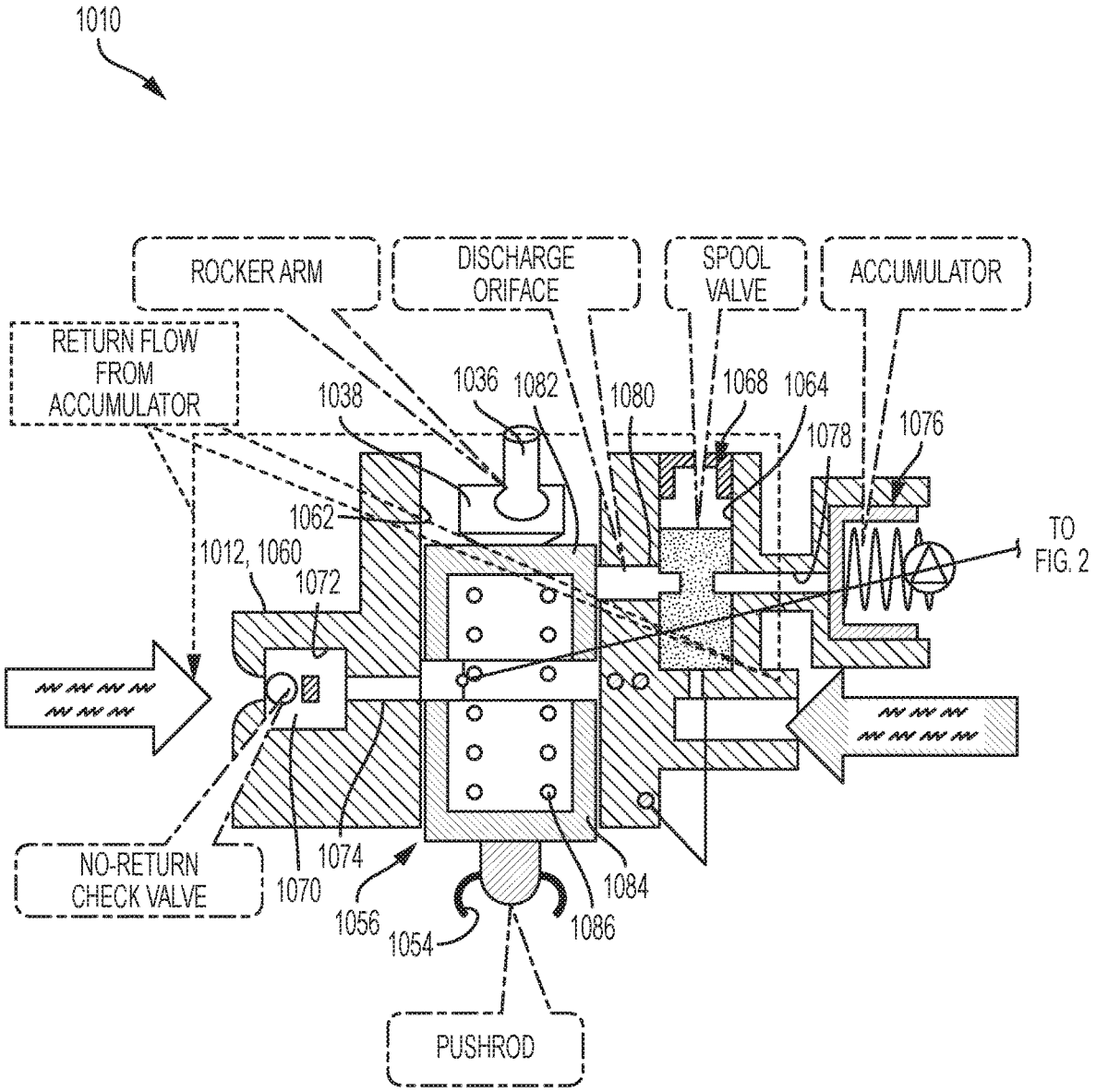
FIG. 35 is a schematic illustration of a partial valve train assembly incorporating a rocker arm assembly constructed in accordance to one example of the present disclosure.
Figure 36:
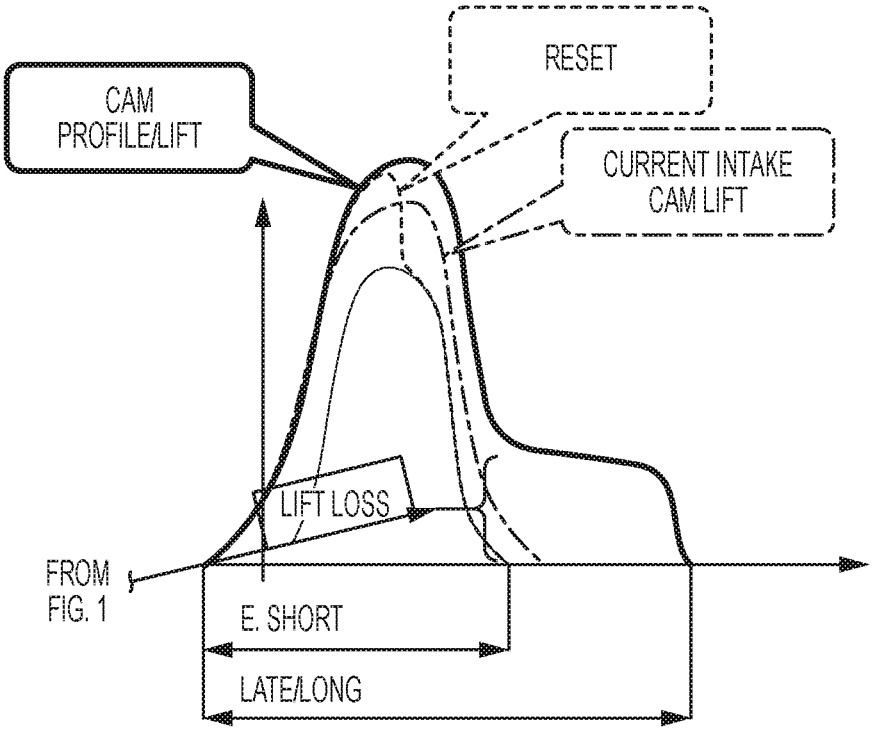
FIG. 36 is a graphical illustration of an example valve lift of the partial valve train assembly shown in FIG. 35.
Figure 37:
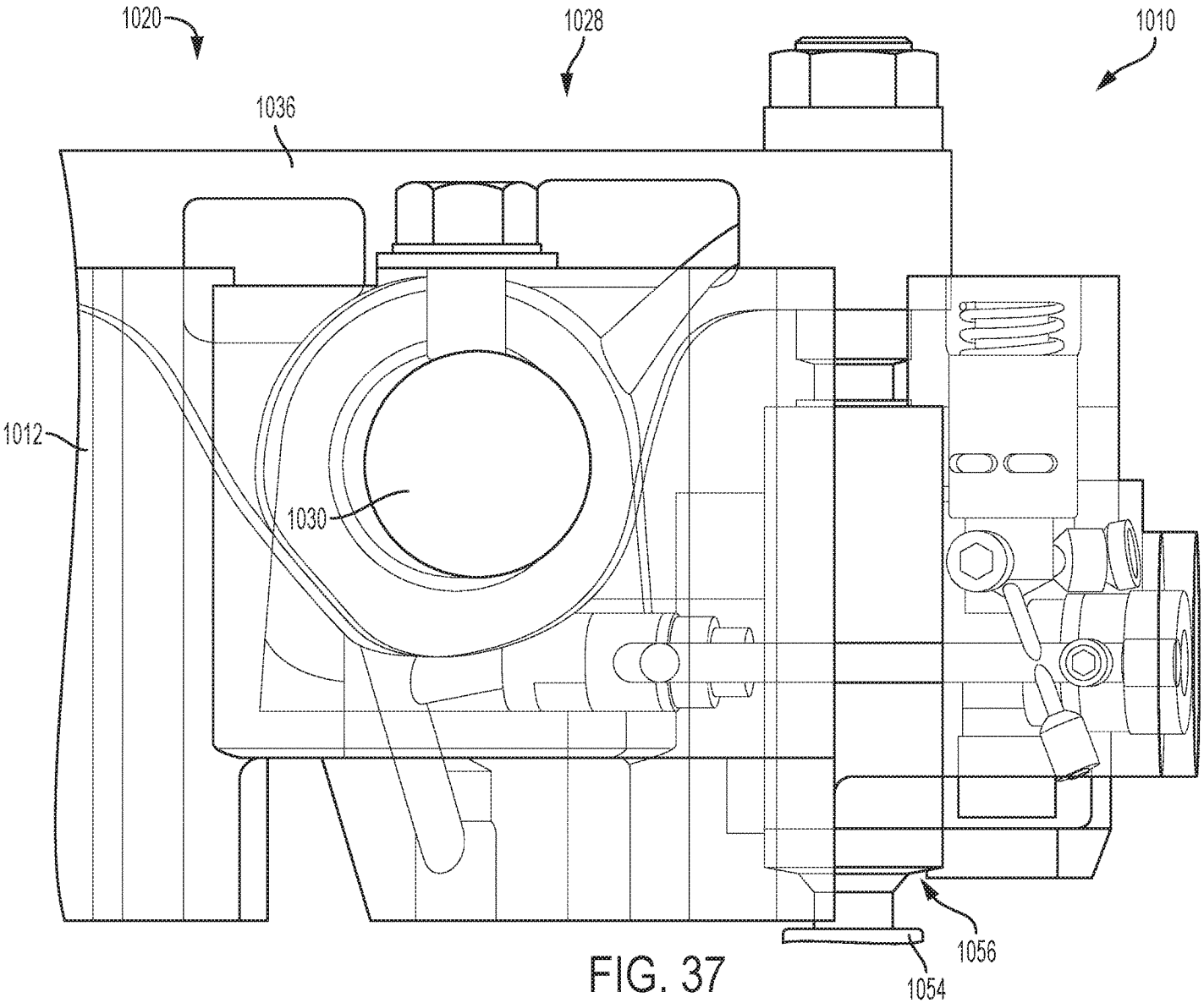
FIG. 37 is a perspective view of the partial valve train assembly shown in FIG. 35 and constructed in accordance to one example of the present disclosure.
Figure 38:
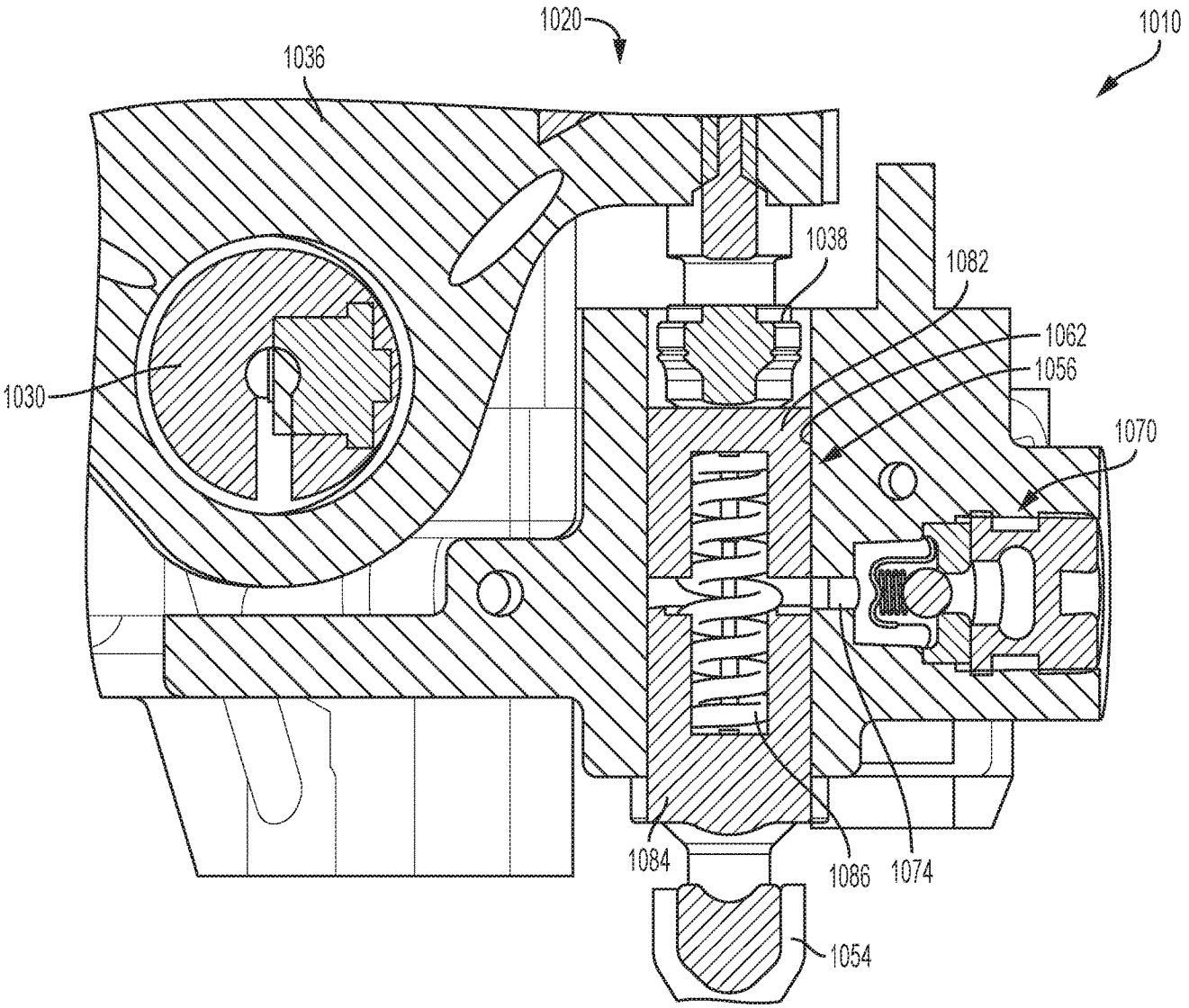
FIG. 38 is a sectional view of the partial valve train assembly shown in FIG. 37.

With initial reference to FIGS. 35-37, a partial valve train assembly constructed in accordance to one example of the present disclosure is shown and generally identified at reference 1000. The partial valve train assembly 1000 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking.

The partial valve train assembly 1000 can include a valvetrain carrier 1012 and a rocker assembly housing 1014 that supports a rocker arm assembly 1020 having a series of intake valve rocker arm assemblies 1028 (only one shown) and a series of exhaust valve rocker arm assemblies (not shown). A rocker shaft 1030 is received by a rocker housing 1032. As will be described in detail herein, the rocker shaft 1030 cooperates with the rocker arm assembly 1020 and more specifically to the intake valve rocker arm assemblies to communicate oil to the intake valve rocker arm assemblies 1028 during early intake valve closing (EIVC) operations.

With further reference now to FIGS. 36 and 37, the intake valve rocker arm assembly 1028 will be further described. In the example embodiment, the intake valve rocker arm assembly 1028 includes a rocker arm 1036 having an e-foot 1038 that is engaged by a pushrod 1054 via a wedge mechanism or variable lift mechanism 1056. The pushrod 1054 moves upward and downward based on a lift profile of a cam shaft (not shown). Upward movement of the pushrod 1054 pushes the rocker arm 1036 and in turn causes the rocker arm 1036 to rotate around the rocker shaft 1030.

With continued reference to FIG. 35, the valvetrain carrier 1012 generally includes a carrier body 1060 defining a first bore 1062 and a second bore 1064. The first bore 1062 receives the variable lift mechanism 1056, and the second bore 1064 receives a spool valve 1068. A check valve 1070 (e.g., ball and spring) is disposed in a cavity 1072 that is fluidly connected to first bore 1062 via a port 1074. An accumulator 1076 is operably associated with spool valve 1068 and is connected thereto via a port 1078. The second bore 1064 is fluidly connected to the first bore 1062 via a discharge orifice or port 1080.

With additional reference to FIGS. 39 and 40, the variable lift mechanism 1056 will be described in more detail. In the example embodiment, the variable lift mechanism 1056 generally includes an upper capsule or cylinder 1082 and a lower capsule or cylinder 1084 that are biased apart by a biasing mechanism (e.g., spring) 1086. The variable lift mechanism 1056 is configured to move between a collapsed position (left, FIG. 39), a rotated, increased lift position (right, FIG. 39), and an extended position (FIG. 35). In this way, variable valve lift mechanism 1056 is configured to provide at least three different lift profiles based on operation in the described positions, as described herein in more detail.

Figure 39:
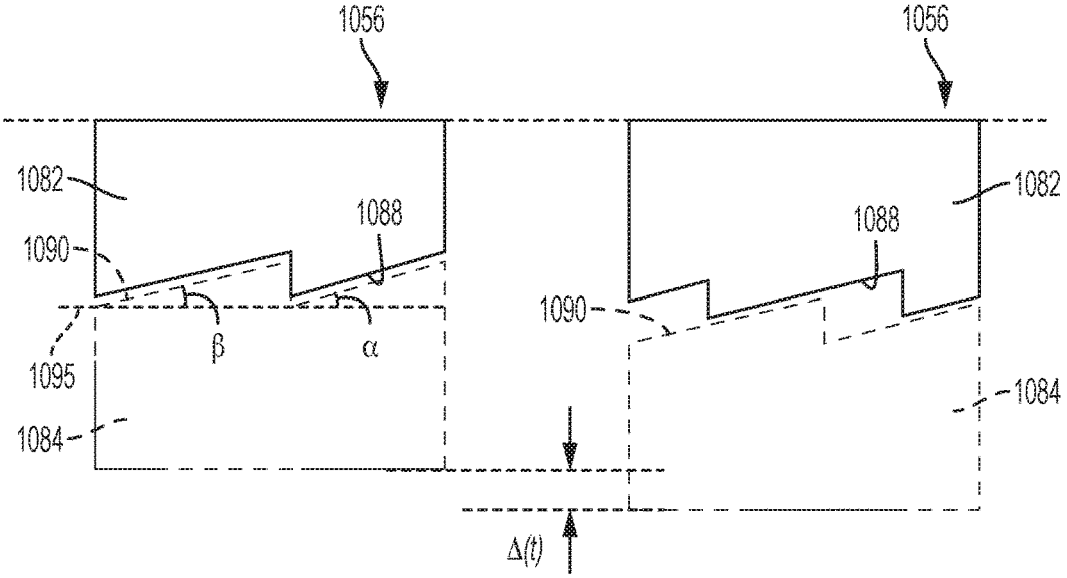
FIG. 39 is side schematic view of a variable lift mechanism of the partial valve train assembly of FIG. 35 constructed in accordance to one example of the present disclosure and shown in two different positions.
Figure 40:
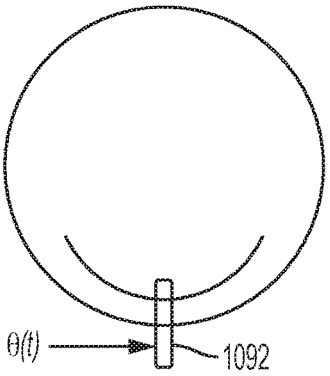
FIG. 40 is a top view of the variable lift mechanism shown in FIG. 39.
Figure 41:
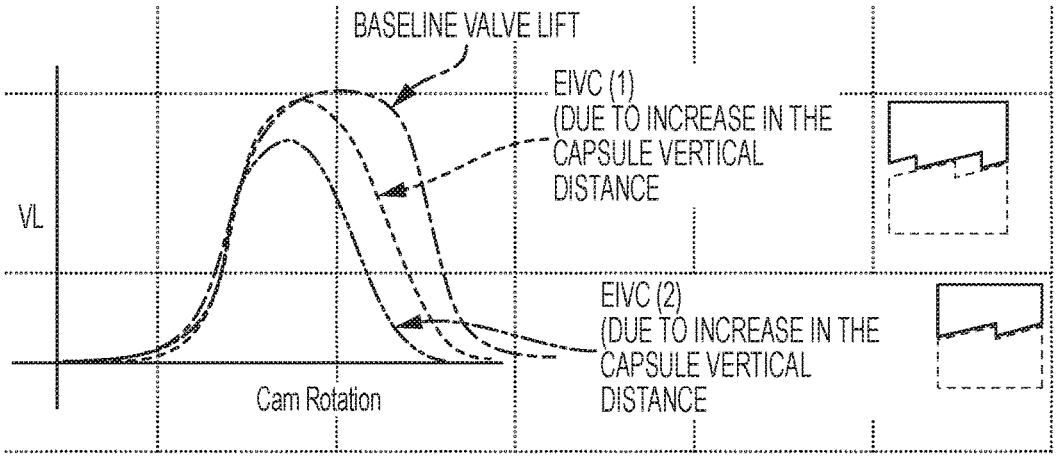
FIG. 41 is a plot illustrating baseline valve lift, EIVC(1) due to increase in the capsule vertical distance, and EIVC(2) due to increase in the capsule vertical distance.

With continued reference to FIG. 39, the upper cylinder 1082 has an upper wedge 1088, and the lower cylinder 1084 has a lower wedge 1090. In the collapsed position, the upper wedge 1088 and the lower wedge 1090 are out of alignment, allowing the variable lift mechanism to collapse against the bias of spring 1086. During actuation, one of the cylinders 1082, 1084, such as upper cylinder 1082, is rotated such that upper wedge 1088 and lower wedge 1090 are aligned for contact. As shown in the rightmost illustration in FIG. 39, upper wedge 1088 rests on lower wedge 1090, which subsequently gives variable lift mechanism 1056 an increased height '$\Delta t$' to produce increased valve lift and, in the example embodiment, a comparatively late early closing of the intake valve (EIVC).

As shown in FIG. 39, in the example embodiment, upper wedge 1088 is disposed at an angle '$\alpha$' and lower wedge 1090 is disposed at an angle '$\beta$' (relative to a horizontal 1095). Varying angle '$\alpha$' and/or '$\beta$' enables varying of '$\Delta t$' to produce a desired lift. In one example, angle '$\alpha$' is between approximately 0° and approximately 45° or between 0° and 45°. In another example, angle '$\beta$' is between approximately 0° and approximately 45° or between 0° and 45°. In the illustrated example, angles '$\alpha$' and '$\beta$' are equal or substantially equal. However, it will be appreciated that angles '$\alpha$' and '$\beta$' may be different.

One example operation of the valvetrain carrier 1012 will now be described. In normal mode, the spool valve 1068 is closed and fluid within the variable lift mechanism 1056 will act as a rigid body and the valve lift we be normal as designed. When the spool valve 1068 opens, the fluid in variable lift mechanism 1056 is drained and the cylinders 1082, 1084 are arranged as shown in FIG. 39, left. In this position, the system produces an EIVC.

With spool valve 1068 open, one of the cylinders 1082, 1084 can then be rotated to be arranged as shown in FIG. 39, right. For example, one of cylinders 1082, 1084 can include a knob 1092 that can be engaged to rotate cylinders 1082, 1084. For example, knob 1092 may be engaged mechanically, hydraulically, magnetically, electrically, etc. In this rotated position, there is a different height of variable lift mechanism 1056 to produce a different lift than in the extended and collapsed positions. It will be appreciated that additional wedges may be provided cylinder 1082 and/or cylinder 1084 to provide additional different lifts.

In some examples, more than three different timings or EIVC is accomplished by providing intermittent positions for knob 1092 while it rotates from zero degrees to a predetermined maximum value. Accordingly, EIVC can be varied between a range of values depending on desired design.

Accordingly, the systems and methods described herein enable at least three different timings of early closing of the intake valve (early intake valve closing). This is achieved by varying the pushrod length by draining the column of liquid present in the two cylinders of a variable lift mechanism. When the spool valve is closed, the incompressible fluid acts as a rigid body. When the spool valve opens and drains the fluid out, the length of the pushrod changes leading to an early closing of the intake valve.

Additionally, at the interface of the two cylinders, a cam-like wedge fitting is provided. A knob can be fitted onto the upper or lower cylinders as desired. The variable lift mechanism can have three orientations. (1) When the spool valve is closed, the fluid will act as a rigid body and the valve lift will be normal. (2) When the spool valve opens and the capsules are arranged as in FIG. 39, left, the variable lift mechanism produces an early closing of the intake valve. (3) When the spool valve opens and the cylinders are rotated and arranged as in FIG. 39, right, the variable lift mechanism produces a different (comparatively late) early closing of the intake valve. In some examples, the valvetrain carrier 1012 can be alternatively configured for LIVC.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A method of providing a rocker arm set for a valvetrain, the method comprising:

providing a first rocker arm configured as a switching rocker arm for a first intake valve; and providing a second rocker arm configured as a fixed rocker arm for a second intake valve, the second rocker arm operating in a normal Otto cycle mode;

wherein the first rocker arm operates in:

a normal Otto mode where the first rocker arm is configured to open the first intake valve later than the second intake valve, and close the first intake valve before the second intake valve without encountering lash variation; and a late intake valve closing (LIVC) mode where the first rocker arm is configured to open the first intake valve later than the second intake valve without encountering lash variation, and close the first intake valve later than the second intake valve such that lash variation is encountered exclusively during a valve closing event of the LIVC mode.

2. The method of claim 1, wherein a valve lift profile of the first rocker arm operating in the normal Otto mode falls within a valve lift profile of the second rocker arm operating in the normal Otto cycle mode.

3. The method of claim 1, further comprising providing the first rocker arm to selectively and alternatively operate in a high-lift mode and a low-lift mode.

4. The method of claim 3, further comprising providing the first rocker arm to operate in the high-lift mode, the lash variation being encountered exclusively during the valve closing event of the high-lift mode.

5. The method of claim 1, further comprising providing the switching rocker arm as a switching roller finger follower (SRFF) having discrete operation in one of a low-lift mode and a high-lift mode.

6. The method of claim 5, further comprising providing the SRFF with an outer arm and an inner arm.

7. The method of claim 6, further comprising providing the SRFF with a latch configured to selectively latch the outer arm to the inner arm.

8. The method of claim 7, wherein when the latch is in a latched condition, the outer arm is latched to the inner arm, and a high-lift lobe of a cam pushes the SRFF follower a first duration, wherein when the latch is in an unlatched condition, the outer arm is movable relative to the inner arm, and a low-lift lobe of the cam pushes the SRFF follower a second duration that is less than the first duration.

9. The method of claim 6, further comprising providing the SRFF with the inner arm configured to be selectively engaged by a low-lift lobe of a cam; and providing the SRFF with two outer arms each having a sliding pad configured to be selectively engaged by respective high-lift lobes of the cam.

10. The method of claim 6, further comprising providing the SRFF inner arm with a roller configured to be selectively engaged by a high-lift lobe of a cam;

providing the SRFF with two outer arms each having a sliding pad configured to be selectively engaged by respective low-lift lobes of the cam;

providing the SRFF with the inner arm and roller disposed between the two outer arms such that the high-lift lobe is disposed between the respective low-lift lobes; and wherein the SRFF roller is provided with a width that is less than a width of the sliding pads such that a width of the high-lift lobe is less than a width of the low-lift lobes.

11. The method of claim 1, further comprising providing the first rocker arm with a first end configured to pivot over a hydraulic lash adjuster; and providing the first rocker arm with an opposite second end configured to actuate the first intake valve.

12. The method of claim 1, wherein in the LIVC mode the first rocker arm is configured to open the first intake valve when the second intake valve is opened.

13. The method of claim 12, wherein a maximum lift of the first intake valve does not exceed a maximum lift of the second intake valve.

14. A valvetrain configuration comprising:

a first rocker arm configured as a switching rocker arm for a first intake valve; and a second rocker arm configured as a fixed rocker arm for a second intake valve, the second rocker arm operating in a normal Otto cycle mode;

wherein the first rocker arm operates in:

a normal Otto mode where the first rocker arm is configured to open the first intake valve later than the second intake valve, and close the first intake valve before the second intake valve without encountering lash variation; and a late intake valve closing (LIVC) mode where the first rocker arm is configured to open the first intake valve later than the second intake valve without encountering lash variation, and close the first intake valve later than the second intake valve such that lash variation is encountered exclusively during a valve closing event of the LIVC mode.

15. The valvetrain configuration of claim 14, wherein the first rocker arm provides a low-lift mode and a high-lift mode.

16. The valvetrain configuration of claim 14, wherein the lash variation is provided by a camshaft lash and a latch lash; and wherein the camshaft lash is a clearance between a camshaft lobe base circle and a point of the first rocker arm that contacts the camshaft lobe, and the latch lash is a clearance between a latch and a latching surface of the first rocker arm.

17. The valvetrain configuration of claim 14, wherein the switching rocker arm is configured as a switching roller finger follower (SRFF);

wherein the SRFF is configured for discrete operation in one of a low-lift mode and a high-lift mode;

wherein the lash variation is experienced exclusively during the valve closing event of the high-lift mode; and wherein the low-lift mode corresponds to a power mode and the high-lift mode corresponds to a fuel economy mode.

18. The valvetrain configuration of claim 17, wherein the lash variation of the valvetrain is encountered exclusively during a valve closing event during the LIVC mode;

wherein an inner arm of the SRFF includes a roller configured to be selectively engaged by a high-lift lobe of a cam;

wherein an outer arm of the SRFF includes a sliding pad configured to be selectively engaged by a low-lift lobe of the cam;

wherein the outer arm includes two outer arms each having a sliding pad configured to be selectively engaged by respective low-lift lobes of the cam;

wherein the inner arm and roller are disposed between the two outer arms such that the high-lift lobe is disposed between the respective low-lift lobes; and wherein a width of the roller is less than a width of the sliding pads such that a width of the high-lift lobe is less than a width of the respective low-lift lobes.

19. The valvetrain configuration of claim 17, wherein the switching rocker arm is configured as a switching roller finger follower (SRFF) that includes an outer arm and an inner arm;

wherein the outer arm is configured to selectively latch to the inner arm;

wherein the inner arm is configured to be selectively engaged by a low-lift lobe of a cam;

wherein the outer arm includes a sliding pad configured to be selectively engaged by a high-lift lobe of the cam;

wherein the outer arm includes two outer arms each having a sliding pad configured to be selectively engaged by respective high-lift lobes of the cam;

wherein the inner arm is disposed between the two outer arms such that the low-lift lobe is disposed between the respective high-lift lobes.

* * * * *